US010407821B2

(12) United States Patent
Clowes

(10) Patent No.: US 10,407,821 B2
(45) Date of Patent: Sep. 10, 2019

(54) METHODS AND APPARATUS FOR LASER CLEANING

(71) Applicant: WOODROW SCIENTIFIC LTD., New Milton, Hampshire (GB)

(72) Inventor: John Redvers Clowes, New Milton (GB)

( * ) Notice: Subject to any disclaimer, the term of this patent is extended or adjusted under 35 U.S.C. 154(b) by 0 days.

(21) Appl. No.: 14/592,657

(22) Filed: Jan. 8, 2015

(65) Prior Publication Data

US 2015/0225891 A1 Aug. 13, 2015

Related U.S. Application Data

(63) Continuation-in-part of application No. PCT/GB2013/000295, filed on Jul. 8, 2013.
(Continued)

(51) Int. Cl.
*B08B 7/00* (2006.01)
*D06L 4/50* (2017.01)
(Continued)

(52) U.S. Cl.
CPC ..... *D06F 75/14* (2013.01); *B08B 7/0035* (2013.01); *B08B 7/0042* (2013.01);
(Continued)

(58) Field of Classification Search
CPC ..... D06L 3/04; D06L 3/12; D06L 4/50; B08B 7/0035; B08B 7/0042
See application file for complete search history.

(56) References Cited

U.S. PATENT DOCUMENTS 3,906,187 A * 9/1975 Turoczi, Jr. ..... D06F 75/08 219/245
5,199,870 A * 4/1993 Steiner ..... A61C 1/0046 433/215
(Continued)

FOREIGN PATENT DOCUMENTS

CN 1817549 A 8/2006
CN 2877948 Y 3/2007
(Continued)

OTHER PUBLICATIONS

Machine translation: Santo et al.; JP11043861; 1999.*
(Continued)

*Primary Examiner* — Mikhail Kornakov
*Assistant Examiner* — Natasha N Campbell
(74) *Attorney, Agent, or Firm* — McCormick, Paulding & Huber LLP

(57) ABSTRACT

A method of cleaning a substrate (16, 24, 34, 64, 71, 82, 102, 165, 171, 181, 201, 300, 310) with optical energy can comprise applying optical energy from a source of optical energy (12, 21, 31, 91, 103, 114, 121, 131, 141, 151, 164, 191, 202) to the substrate. The method can comprise applying the optical energy to a substrate having a cleaning agent applied thereto, the optical energy having one or more optical parameters selected for cleaning the substrate. The method can comprise reading data from a data bearing element (173) associated with the substrate, communicating the data to a processor (154) associated with a cleaning appliance (10, 30, 40, 60, 70, 80, 90, 110, 120, 130, 140, 150, 161, 200) comprising the source of optical energy, wherein the processor, responsive to the communicated data, controls the cleaning of the substrate with the optical energy. The method can comprise slidingly contacting the substrate with a work surface, said work surface comprising an aperture (83, 117) and emanating optical energy from the
(Continued)

aperture for cleaning the substrate. A cleaning appliance can comprise an appliance body (80, 90, 104, 125) comprising an aperture for emanating optical energy for cleaning the substrate and an optical transmission pathway arranged for propagating optical energy received from an optical energy source to said aperture. The appliance can be adapted and constructed for delivering a cleaning agent to the substrate. The appliance can include a processor, a data interface in communication with the processor, and can be configured such that the processor outputs signals that control the cleaning of the substrate, the processor being configured for controlling, responsive to data received by the data interface and via the output signals, the substrate cleaning. The cleaning appliance can include a suction pump (142) for removing material from the substrate.

24 Claims, 21 Drawing Sheets

Related U.S. Application Data

(60) Provisional application No. 61/670,114, filed on Jul. 10, 2012, provisional application No. 61/927,971, filed on Jan. 15, 2014, provisional application No. 61/928,404, filed on Jan. 16, 2014.

(51) Int. Cl.

| | |
|---|---|
| ***D06F 33/02*** | (2006.01) |
| ***D06F 35/00*** | (2006.01) |
| ***D06F 75/14*** | (2006.01) |
| ***D06F 43/00*** | (2006.01) |
| ***D06F 75/24*** | (2006.01) |
| ***D06L 1/00*** | (2017.01) |
| ***B08B 7/04*** | (2006.01) |
| ***D06L 1/12*** | (2006.01) |
| ***C11D 3/39*** | (2006.01) |
| ***C11D 11/00*** | (2006.01) |

(52) U.S. Cl.

CPC ..... *C11D 3/3947* (2013.01); *C11D 11/007* (2013.01); *D06F 43/002* (2013.01); *D06L 1/00* (2013.01); *D06L 4/50* (2017.01); *D06F 33/02* (2013.01); *D06F 35/00* (2013.01); *D06F 75/246* (2013.01); *D06F 2202/10* (2013.01)

(56) References Cited

U.S. PATENT DOCUMENTS

| | | | | |
|---|---|---|---|---|
| 5,766,266 | A | 6/1998 | Ripley et al. | |
| 5,800,165 | A * | 9/1998 | Kirsch | A61B 1/24 433/215 |
| 6,056,548 | A * | 5/2000 | Neuberger | A46B 15/0002 433/215 |
| D548,418 | S | 8/2007 | Cahen | |
| 7,257,911 | B2 | 8/2007 | Voitchovsky | |
| 7,562,474 | B2 | 7/2009 | Voitchovsky | |
| 8,099,882 | B2 | 1/2012 | Voitchovsky | |
| 2002/0029498 | A1 * | 3/2002 | Harrison | D06F 75/08 38/75 |
| 2003/0121896 | A1 * | 7/2003 | Yu | B08B 7/0042 219/121.68 |
| 2004/0049955 | A1 | 3/2004 | Denisart et al. | |
| 2004/0172867 | A1 | 9/2004 | Voitchovsky | |
| 2005/0086847 | A1 * | 4/2005 | Paulkovich | F41B 9/00 42/114 |
| 2008/0276966 | A1 * | 11/2008 | Yusuf | D06F 33/02 134/18 |
| 2009/0061391 | A1 * | 3/2009 | Lukac | A61C 19/063 433/215 |
| 2010/0058624 | A1 | 3/2010 | Voitchovsky | |
| 2011/0049114 | A1 | 3/2011 | Barkhausen et al. | |
| 2011/0185604 | A1 | 8/2011 | Voitchovsky | |
| 2012/0053387 | A1 | 3/2012 | Thro et al. | |
| 2015/0218746 | A1 | 8/2015 | Clowes | |

FOREIGN PATENT DOCUMENTS

| | | | | |
|---|---|---|---|---|
| CN | 2885918 | Y * | 4/2007 | |
| CN | 201058946 | Y | 5/2008 | |
| CN | 201720218 | U | 1/2011 | |
| CN | 102159762 | A | 6/2012 | |
| DE | 19900910 | A1 | 7/2000 | |
| DE | 19944934 | A | 6/2001 | |
| DE | 10113494 | A1 | 10/2002 | |
| DE | 102004009687 | A1 | 9/2005 | |
| DE | 102007020748 | A1 | 11/2008 | |
| EP | 0750066 | B1 | 11/2000 | |
| EP | 1848852 | B1 | 3/2011 | |
| EP | 2452010 | A2 | 5/2012 | |
| EP | 2142333 | B1 | 7/2014 | |
| JP | 11043861 | A * | 2/1999 | |
| JP | 2001269636 | A | 10/2001 | |
| JP | 2002301439 | A | 10/2002 | |
| JP | 2002343761 | A | 11/2002 | |
| JP | 2003193364 | A * | 7/2003 | |
| KR | 100871451 | B1 | 12/2008 | |
| RO | 121547 | B1 | 11/2007 | |
| TW | I311646 | B | 7/2009 | |
| WO | 9930865 | A1 | 6/1999 | |
| WO | 02064874 | A2 | 8/2002 | |
| WO | 2004085921 | A1 | 10/2004 | |
| WO | 2005014917 | A1 | 2/2005 | |
| WO | 2006085285 | A1 | 8/2006 | |
| WO | 2008081352 | A1 | 7/2008 | |
| WO | 2008135455 | A1 | 11/2008 | |
| WO | WO-2012073150 | A2 * | 6/2012 | A47L 25/08 |

OTHER PUBLICATIONS

Machine translation: Oouchi, A.; JP 2003-193364; 2003.*

Machine translation of CN2885918: Yu, D.; 2007.*

European Examination Report, 'Communication Pursuant to Article 94(3) EPC', dated Jul. 11, 2017, in European Patent Application No. 13742257.2 (Note: Document D2, U.S. Pat. No. 5,766,266, referenced in the cited Examination Report, has previously been made of record in the parent case—U.S. Appl. No. 14589695—to the present case).

Meg Abraham, Odile Madden, Stephanie Scheerer; The Use of Added Matrix Elements Such As Chemical Assistants, Colorants and Controlled Plasma Formation as Methods to Enhance Laser Conservation of Works of Art, Journal of Cultural Heritage 4, 2003, Elsevier (Cited in related case, U.S. Appl. No. 14/589,695, IDS dated Apr. 13, 2017).

Belli, R., Miotello, A., Mosaner, P. et al. Appl. Phys. A (2006) 83: 651. doi:10.1007/s00339-006-3530-3 (Cited in related case, U.S. Appl. No. 14/589,695, IDS dated Apr. 13, 2017).

J. Krüger, et al.; Lasers in the Conservation of Artworks, Springer Proceedings in Physics, 2007, 1, 116, Springer Berlin Heidelberg (Cited in related case, U.S. Appl. No. 14/589,695, IDS dated Apr. 13, 2017).

Howard Sutcliffe, Martin Cooper, Janet Farnsworth; An Initial Investigation into the Cleaning of New and Naturally Aged Cotton Textiles Using Laser Radiation, Journal of Cultural Heritage, Aug. 1, 2000, 1.1, Elsevier Science (Cited in related case, U.S. Appl. No. 14/589,695, IDS dated Apr. 13, 2017).

Rule 161 Communication from the European Patent Office (Cited in related case, U.S. Appl. No. 14/589,695, IDS dated Apr. 13, 2017).

International Search Report, P302.WO, PCT/GB2015/050018, dated Jun. 26, 2015 (Cited in related case, U.S. Appl. No. 14/589,695, IDS dated Apr. 13, 2017).

Written Opinion of the International Searching Authority, PCT/ISA/220, PCT/GB2015050018, dated Jun. 26, 2015 (Cited in related case, U.S. Appl. No. 14/589,695, IDS dated Apr. 13, 2017).

(56) References Cited

OTHER PUBLICATIONS

Preliminary Amendment from U.S. Appl. No. 14/589,695, related application to present application.
International Search Report and Written Opinion of the International Searching Authority, PCT/GB2013/000295, dated Feb. 21, 2014.

* cited by examiner

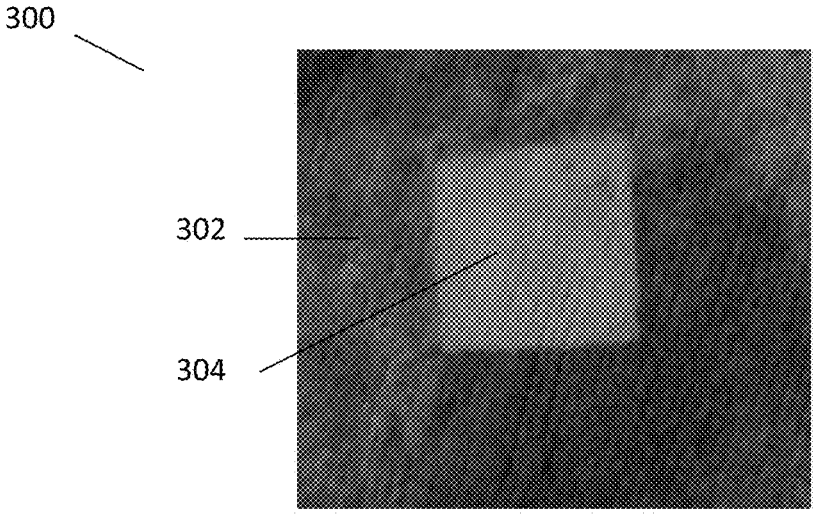
Figure 20
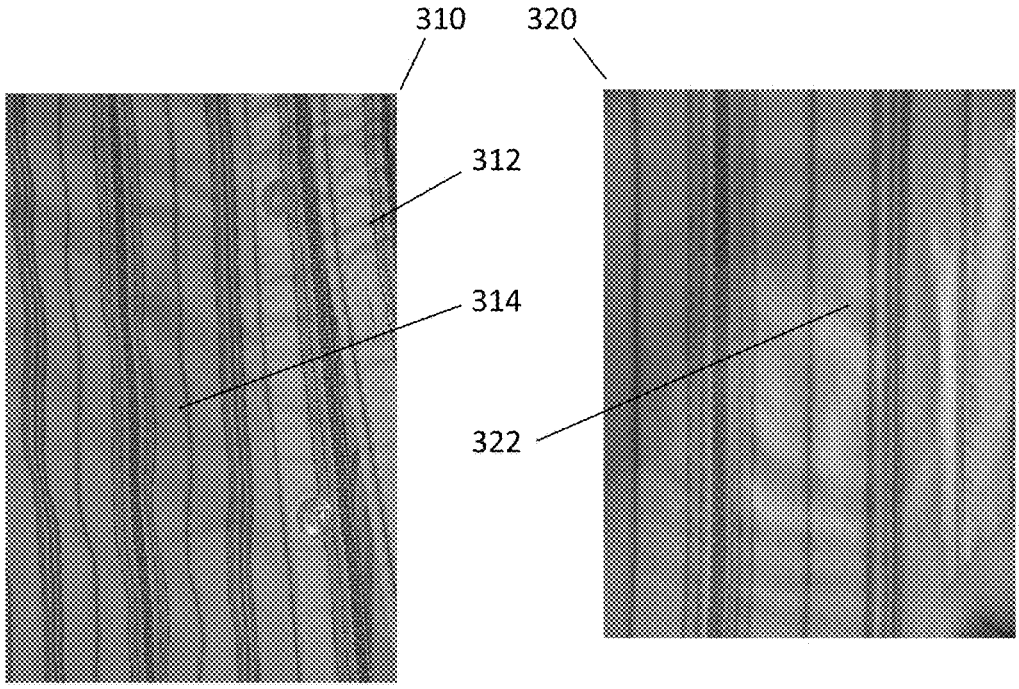
Figure 21a
Figure 21b

METHODS AND APPARATUS FOR LASER CLEANING

FIELD OF THE INVENTION

The present invention relates to an apparatus and methods of cleaning substrates using optical energy. More particularly, the invention is concerned with using optical energy to clean substrates, including the combined use of optical energy and cleaning agents to enhance cleaning, such as, for example, enhancing stain removal.

BACKGROUND

Conventional cleaning apparatus and processes typically utilise an aqueous method or a method which utilises chemicals. Consider, for example, household washing machines or dry cleaning, which is more commonly used within industrial cleaning processes.

Domestic cleaning of clothes or other fabric articles typically involves hand washing processes or more commonly front or top-loaded drum-style washing machines which employ both an aqueous and mechanical cleaning process, often requiring large amounts of detergents and stain removal chemicals. Such machines have a high consumption of both water and power, with an average domestic washing machine using between 9-10 liters of water and consuming approximately 0.75 KW-hour electricity per wash load. Once the items are cleaned, the very nature of the cleaning process leaves the articles quite wet and requires subsequent drying, either in an inefficient machine such as a commercial tumble drier or through inefficient use of a building's heating system (radiators, etc.) or through outside drying via direct sunlight and/or wind.

Dry cleaning processes typically involve extensive use of hydrocarbon solvents such as perchloroethylene, and the storage, treatment and disposal of such chemicals may pose environmental concerns. Furthermore, dry cleaning equipment is specialized and is often extremely expensive and non-portable.

The cleaning of carpets and upholstery, both in the domestic as well as industrial environment, typically uses hot water or steam processes and, in many cases, these processes again leave the material soaked to dry out gradually over time. For industrial applications, for example in the transport sector where seats of passenger aircraft, trains and buses require regular cleaning, this can involve periods of "down time" where the vehicle is not used so as to allow the cleaned upholstery to dry.

In modern society, many articles being cleaned using conventional method and apparatus are very lightly or locally soiled. For example, a shirt may have a dirty collar and cuffs and perhaps have an odour in certain regions of the shirt. Nevertheless, the item is fully washed simply because there is a small oil or food stain in a very localised area. In a household setting, the use of a washing machine to clean such items on a daily basis can be excessive, and can result in degradation of the lifetime of the article due to the mechanical nature of the cleaning process and the need, very often, for drying of the garment in direct sunlight.

SUMMARY OF THE INVENTION

In consideration of one or more of the disadvantages with conventional cleaning methods and apparatus, the present inventor has devised novel processes and apparatus for cleaning substrates, such as substrates comprising fabric materials. One or more of the amount of water, steam and/or chemicals, as well as the electrical power, used within prior art methods can in many instances be significantly reduced.

In broad aspect, the invention provides methods and apparatus for cleaning a substrate, such as a fabric material (including a "practical" fabric material, as defined below), involving the application of optical energy to the substrate, typically in the form of a beam of light, where the energy of the beam causes cleaning of the contaminant, such as a stain, from the substrate, such as from the fibers of a fabric material. The cleaning may occur via any mechanism, including one or more of, alone or in any combination, ablation, melting, heating or reaction with the substrate or contaminant or agent introduced to aid in the cleaning. For example, stain removal can include reaction with the particular contaminant to change the visibility of the contaminant. The optical energy is typically applied to a selected area of the substrate (e.g., as a beam), and the substrate and beam moved relative to one another so as to clean a larger area of the substrate, either by moving the substrate or the beam, or both. Movement of the beam with respect to the substrate can be attained through a beam scanning mechanism or through movement of the optical source itself. The optical energy can be applied to one surface of the substrate or, if both surfaces are accessible, multiple surfaces can be exposed to the optical energy to enhance the cleaning depth within the substrate.

By way of example and not limitation, contaminants to be cleaned can be one or more of (or any combination of) dirt particles, molecules and particles chemically bonded to textile fibers, bodily fluids, food stains and food substances, bacteria and odour-inducing particles and molecules or substances, oils, greases, biological materials, and nuclear particles. Contaminants can be organic or inorganic, or combinations of both organic and inorganic materials.

The optical energy is preferably delivered to the substrate as a beam. The beam of light can be divergent, providing a broad area of illumination or can be collimated or focused to a much more confined region of the substrate using appropriate beam shaping and/or focussing optics. The focused or collimated beam can be in any shape but would preferably be in the form of a spot or a stripe. The optical energy can be in the form of a narrow spectral band, several different narrow spectral bands, or can be broadband and comprise many wavelengths of light in a continuum spectrum (e.g., the source of optical energy can comprise a supercontinuum source). The optical energy can comprise a wavelength selected to clean a specific contaminant from a substrate. The source of optical energy can comprise a wavelength-filtered light source and can further allow for the selection of a particular wavelength to achieve optimized contaminant cleaning dependent on the contaminant and/or substrate make-up.

Methods and apparatus of the invention can, respectively, include steps or be adapted for assisting the cleaning of the contaminant from the substrate, such as helping extract the contaminant (e.g., via chemical action), blowing away the contaminant or providing an activation mechanism to the contaminant cleaning process. For example, water can be introduced to dampen the contaminated substrate, steam to provide heat, moisture or pressure to the cleaning process, vacuum or compressed air to provide removal of mobile cleaned contaminant particles through suction or by blowing the contaminant away from the substrate. Cleaning agent chemicals, including detergents, stain removers, oxygen based bleaching agents, enzymes, surfactants and anti-oxidants, may provide a chemical reaction to assist the removal of the contaminant or stain, such as from the fibers of a substrate comprising a fabric material. When applying a liquid such as water or a cleaning agent such as a detergent solution, it is preferable to replenish the cleaning agent regularly to extract removed contaminant from the region of the substrate being cleaned, thus preventing re-absorption and re-staining of the material. This is best achieved using a flow of the solution or liquid, including a flow for applying the cleaning agent to the substrate and a flow of soiled cleaning agent being removed from the substrate.

The cleaning agent solution used to assist the cleaning process is preferably particularly adapted for use with a given optical source and for cleaning a given contaminant. For example, the chemical may have an additive which has increased absorption of the optical energy from the light source, thus enhancing the efficiency of localised heating within the fabric. This additive is selected to have optical absorption at one or more wavelengths of the given optical source. The additive may have no other substantial function.

Alternatively, the cleaning agent chemical used to assist the optical cleaning process may be an existing commercial product such as a household laundry detergent or stain remover, but, when used with an optical source or apparatus according to the present invention, has improved cleaning or stain removal capability or can achieve the cleaning without conventional high temperature aqueous laundry processes. The optical energy from the optical source provides localised heat which increases the effectiveness of the chemical cleaning agents such as detergent, enzyme or bleaching agent. The optical energy can also increase the mobility of the contaminant molecules making them easier to react with the chemical and remove form the fabric.

Methods and apparatus of the invention can, respectively, include steps or be adapted for sensing the speed of translation of the beam with respect to the substrate and controlling the speed and the optical energy dosage delivered to prevent over exposure and damage of the substrate, as well as, additionally or alternatively, interlocking the source of optical energy (e.g., laser source) such that it is made very difficult to operate the source whilst potentially exposing the skin and/or eyes of the a user to the optical radiation. The appliance can include a motion detector to sense motion of the beam and/or the appliance from which the beam is delivered to ensure that one local region of the material being cleaned or ironed is not continually exposed to the optical energy or exposed to an undesired dosage of optical energy, resulting in degradation or damage locally to the material. The motion detector would preferably be interlocked to the optical source to switch off the source or reduce its intensity in the event that the appliance motion slows or stops, and this could be effected via appropriate configuration of a processor in control of the source of optical energy, or an optical conditioning apparatus (e.g., an attenuator or modulator or beam deflector) in the optical path used to deliver the beam to the substrate, as well as in communication with the appropriate motion or other sensors. The type or nature of the substrate can be sensed as well as the rate of removal and type of removed contaminant, such that automated scanning and power delivery of the light beam can be incorporated into the methods or apparatus of the cleaning invention, such as via the configuration of the processor and apparatus.

Alternatively, a cleaning appliance processor can be programmed according to the type or brand of substrate (e.g., fabric) being cleaned, the contaminant being cleaned, the type or brand of detergent being used or any combination of these parameters, to control characteristics or parameters of the optical beam or of the cleaning process (e.g., the type or delivery of a cleaning agent).

The programmable appliance presents an upgradable solution to cleaning, whereby improvements in fabrics, detergents and cleaning processes become available to a user of the appliance which can be upgraded through communication with the processor of new data or a software or firmware upgrade of the appliance. In this instance, the appliance can include an on-board processor and means for inputting, such a data transfer interface, and possibly outputting data from the appliance. The appliance can include a USB or Ethernet or any other type of input/output communications port.

The upgrade to the appliance in the process parameters can be achieved by downloading processes from the internet, this process information being provided by the manufacturers of the textile, clothing items, detergent, the appliance itself or from other users of the appliance.

Specific process parameters can alternatively be communicated to the programmable appliance through, for example, a bar-code scan or any other form of upload. Process parameters provided with the substrate, fabric or detergent can also be manually entered into the appliance. For example, a method may be introduced whereby new laundry detergents and cleaning products have a "scanable" process optimisation, proven in the manufacturer's laboratory to improve the process, either through improved cleaning quality or through reduced energy inputs, lower temperature cleaning requirements or other improvement parameters. The appliance can have a built-in processor and scan mechanism which enables the processes to be optimised for use with the new or different cleaning product. The same can be true for a new garment or textile which can have optimum cleaning parameters included on, for example, a label within the garment or textile. The cleaning process is then modified such that the textile is cleaned more efficiently or the lifetime of the textile is enhanced due to reduced wear from the cleaning process. The programmable appliance therefore provides a means for optimising cleaning of textiles based on the improvements in textiles, detergents and user experience.

The foregoing features noted herein, such as above, regarding the use of a processor and control of the cleaning process via communication of new data or software or firmware to the processor or appliance, such as information relating to a substrate to be cleaned, is not limited to use with cleaning processes using optical energy, but can be applied to conventional washing or cleaning or other procedures, such as in conventional washer, dryer, dry cleaner or pressing process, where cleaning agent type, wash cycle, temperature, characteristics could be controlled or specified responsive to a processor receiving data from, for example, a bar code or other machine readable data element associated with the substrate, such as by being affixed to, printed on, of otherwise integrated with the substrate, such a textile.

Generally speaking, typically the make-up of a cleaning agent will comprise one or more of a surfactant, enzyme, oxygen-based bleaching agent, water softener, anti-redeposition agent or optical brightener. Preferably the chemical will contain an oxygen-based bleaching agent such as Sodium Percarbonate whose stain removal properties are enabled or enhanced by the optical energy absorbed locally within the fabric material. The detergent or stain remover chemical can contain less than 5% of the oxygen-based bleaching or oxidizing agent. The detergent or stain remover chemical can contain more than 5% of the oxygen-based bleaching or oxidizing agent. The stain remover can contain more than 15% of the oxygen-based bleaching or oxidizing agent. The stain remover can contain more than 30% of the oxygen-based bleaching or oxidizing agent. The liquid can comprise a solvent selected to clean a contaminant from the fabric material. Percentages can be by weight.

For example, a chemical (cleaning agent, such as a stain remover) is applied to the substrate during the optical cleaning process, such chemical is preferably applied in the form of a liquid or solution. The solution can be applied to the substrate as a stream, spray or mist. The solution can be applied to the substrate once prior to carrying out the optical cleaning process. During the cleaning process, the substrate can be substantially immersed in the solution. During the optical cleaning process, the solution can be continually or repeatedly applied to the substrate as a spray or flow, enabling the solution to be replenished. During the continual or repeated application of the solution to the substrate, there is preferably a removal process where previously applied solution can be cleaned from the substrate area, said previously applied solution having been used to remove stain or contaminant molecules from the substrate and hence said previously applied solution containing removed stain or contaminant molecules.

A method of cleaning a substrate can involves the use of optical energy with an existing or developed commercial cleaning agent such as a detergent or stain remover, said combination of the cleaning agent and optical energy providing one or more of an enhanced cleaning performance, enhanced stain removal, more efficient cleaning or stain removal process, more convenient cleaning or stain removal process or more environmentally friendly cleaning or stain removal process.

A method of upgrading the performance of a substrate cleaning process can involve modifying the parameters of the cleaning process automatically by importing cleaning parameters into a processor controlled cleaning appliance, the cleaning parameters being optimised for a given cleaning agent, type of fabric, brand of fabric or cleaning agent, or through improved understanding of the performance of the cleaning appliance through continued experience.

Although the invention is often described herein in terms of the cleaning of substrates comprising fabric material, the invention can be broader in scope. The methods and apparatus described herein are considered suitable for the cleaning of a wide variety of substrates including, for example, paper, leather, plastics, glass, metals, paints, wood, cardboard and masonry.

More detailed aspects and embodiments are now described below. However, any of the features of the foregoing broad aspects, as well as those described in more detail below, taken alone or in combination, can apply to any of the embodiments or aspects described herein, except where features are clearly mutually exclusive or explicitly stated to be incompatible.

In one aspect of the invention, there is provided a method of cleaning a substrate with optical energy, comprising applying cleaning agent to the substrate; and applying optical energy from a source of optical energy to the substrate having the cleaning agent applied thereto, the optical energy having one or more optical parameters selected for cleaning the substrate.

The cleaning agent can comprise a bleaching agent. The cleaning agent can comprise an oxidizing agent. The cleaning agent can comprise, in various practices of the invention, at least 5% by weight of the oxidizing agent; at least 10% by weight of the oxidizing agent; at least 15% by weight of the oxidizing agent; at least 20% by weight of the oxidizing agent; or at least 25% by weight of the oxidizing agent.

The source of optical energy can comprise a laser. The source of optical energy can comprise a plurality of lasers. The source of optical energy can comprise a plurality of diode lasers.

Applying the optical energy can comprise applying the optical energy so as to heat one or both of the cleaning agent or at least a portion of the substrate to a temperature of, in various practices of the invention, at least 40 degrees Celsius; at least 50 degrees Celsius; or at least 60 degrees Celsius. Applying the optical energy can comprise applying the optical energy so as to heat the cleaning agent to a temperature of, in various practices of the invention, at least 40 degrees Celsius; at least 50 degrees Celsius; or at least 60 degrees Celsius. Applying the optical energy can comprise applying the optical energy so as to heat at least a portion of the substrate to a temperature of, in various practices of the invention, at least 40 degrees Celsius; at least 50 degrees Celsius; or at least 60 degrees Celsius.

The method can comprise removing, after the step of applying optical energy to the substrate having the cleaning agent applied thereto, cleaning agent from the substrate. The method can comprise applying, subsequent to the removal of cleaning agent, additional cleaning agent to the substrate.

The optical energy having one or more optical parameters selected for cleaning the substrate can comprise the optical energy having a peak power of, in various practices of the invention, no greater than 1 kW; no greater than 500 W; or no greater than 100 W. The optical energy having one or more optical parameters selected for cleaning the substrate can comprise the optical energy having a duty cycle of, in various practices of the invention, no less than 10%; no less than 20%; no less than 40%; or no less than 75%. The optical energy having one or more optical parameters selected for cleaning the substrate comprises the optical energy comprising CW optical energy.

The cleaning agent can comprise an absorbing agent for enhancing absorption of the optical energy by the cleaning agent. The absorbing agent can otherwise be substantially inactive in relation to the cleaning process. The absorbing agent can substantially increase the optical absorption of the cleaning agent.

In another aspect of the invention, there is provided a method of cleaning a substrate using optical energy, comprising reading data from a data bearing element associated with a substrate to be cleaned; communicating the data to a processor associated with a cleaning appliance comprising a source of optical energy; and applying optical energy from the source of optical energy of the cleaning appliance to the substrate for cleaning the substrate, wherein the processor, responsive to the communicated data, controls the cleaning of the substrate with the optical energy.

The data bearing element can be integral with the substrate. The data bearing element can comprise machine readable modifications of the substrate, such as, for example, machine readable printing on the substrate. The data bearing element can comprise a bar code. The data bearing element can comprise a radio frequency identification (RFID) tag.

The processor, responsive to the communicated data, can control one or more of, in any combination, the delivery of a cleaning agent to the substrate; the removal of cleaning agent from the substrate; or one or more characteristics of the optical energy applied to the substrate. The processor can control the characteristic of the optical energy comprising the duty cycle of the optical energy. The processor can control the characteristic of the optical energy comprising the optical power of the optical energy. The processor can control the characteristic of the optical energy comprising the pulse duration of the optical energy.

Reading the data can comprise machine reading of the data, such as reading the data with an electro-optical device, such as a bar code scanner or wireless device.

In yet a further aspect of the invention, there is disclosed a cleaning appliance for cleaning a substrate, comprising an appliance body comprising an aperture for emanating optical energy for cleaning the substrate; an optical transmission pathway arranged for propagating optical energy received from an optical energy source to said aperture for emanation of the optical energy for the cleaning; a processor; a data interface in communication with the processor; wherein the laser cleaning appliance is configured such that the processor can output signals that can control the cleaning of the substrate by the laser cleaning appliance; and wherein the processor is configured for controlling, responsive to data received by the data interface and via the output signals, the cleaning of the substrate.

The cleaning appliance and processor can be configured such that the processor can control the cleaning of the substrate by controlling one or more characteristics of the optical energy emanated by the aperture, such as, for example, the characteristic of the optical energy comprising the duty cycle of the optical energy; the characteristic of the optical energy comprising the optical power of the optical energy; or the characteristic of the optical energy comprising the pulse duration of the optical energy.

The cleaning appliance can be adapted and constructed for delivering a cleaning agent to the substrate and wherein the laser appliance and processor are configured such that the processor can control the cleaning of the substrate by controlling the delivery of the cleaning agent to the substrate. The laser cleaning appliance can be adapted and constructed for removing cleaning agent from the substrate and wherein the laser appliance and processor are configured such that the processor can control the cleaning of the substrate by controlling the removal of cleaning agent from the substrate.

The cleaning appliance can comprise the source of optical energy, the source of optical energy being disposed within said appliance body, and wherein the laser appliance and processor are configured such the processor can control the cleaning of the substrate by controlling the operation of the source of optical energy.

In a further aspect, the invention provides a cleaning appliance for cleaning a substrate, comprising an appliance body comprising an aperture for emanating optical energy for cleaning the substrate; an optical transmission pathway arranged for propagating optical energy received from an optical energy source to said aperture for emanation of the optical energy for the cleaning; and wherein said appliance is adapted and constructed for delivering a cleaning agent to the substrate. The appliance can be adapted and constructed for delivering the cleaning agent to an area of the substrate on which the optical energy emanating from the aperture is incident.

The cleaning appliance can comprise a work surface arranged such that said work surface is in physical contact with the substrate during cleaning of the substrate. The laser cleaning appliance can comprise a suction pump for removing material from the substrate.

The source of optical energy can comprise a laser. The cleaning appliance can comprise the source of optical energy. The source of optical energy can be disposed within said appliance body. The source of optical energy can be arranged such that it is portable with the appliance body. The source of optical energy can comprise a plurality of lasers. The source of optical energy can comprise a plurality of laser diodes.

The cleaning appliance can be adapted and constructed such that the optical energy emanated by said aperture has a peak power of, in various practices of the invention, no greater than 1 kW; no greater than 500 W; or no greater than 100 W. The laser cleaning appliance can be adapted and constructed such that the optical energy emanated by said aperture has, in various practices of the invention, a duty cycle of no less than 10%; no less than 20%; no less than 40%; or no less 75%.

The cleaning appliance can comprise cleaning agent. The cleaning agent can comprise an oxidizing agent. The cleaning agent can comprise, in various practices of the invention, at least 5% by weight; at least 10% by weight; at least 15% by weight; at least 20% by weight; or at least 25% by weight of the oxidizing agent.

In yet another aspect of the invention, there is provided a cleaning appliance for cleaning a substrate, comprising: an appliance body comprising an aperture for emanating optical energy for cleaning the substrate; an optical transmission pathway arranged for propagating optical energy received from an optical energy source to said aperture for emanation of the optical energy for the cleaning; and wherein said laser cleaning appliance includes a suction pump for removing material from the substrate.

The cleaning appliance can comprise a work surface arranged such that said work surface is in physical contact with the substrate during cleaning of the substrate. The source of source of optical energy can comprise a laser. The laser cleaning appliance can comprise the source of optical energy, the source of optical energy being disposed within said appliance body. The source of optical energy can comprise a plurality of lasers. The source of optical energy company can comprise a plurality of laser diodes.

The cleaning appliance can be adapted and constructed such that the optical energy emanated by said aperture has a peak power of, in various practices of the invention, no greater than 1 kW; no greater than 500 W; or no greater than 100 W. The laser cleaning appliance can be adapted and constructed such that the optical energy emanated by said aperture has, in various practices of the invention, a duty cycle of no less than 10%; no less than 20%; no less than 40%; or no less 75%.

In yet a further additional aspect of the invention there is provided a method of cleaning a substrate, comprising slidingly contacting the substrate with a work surface, said work surface comprising an aperture; and emanating optical energy from the aperture for cleaning the substrate.

A number of yet additional aspects of the invention, including methods and apparatus, are now presented in more detail. Again, any of the features of the foregoing aspects, as well as those described in more detail below, taken alone or in combination, can be included in any of the embodiments or aspects described herein, except where features are clearly mutually exclusive or explicitly stated to be incompatible.

In one aspect of the invention, a portable cleaning appliance can comprise an appliance body comprising an aperture for emanating optical energy for cleaning and an optical transmission pathway arranged for propagating optical energy received from an optical energy source to the aperture for emanation of the optical energy for the cleaning. The portable cleaning appliance can be adapted and constructed so as to be hand held and for cleaning a fabric material, including cleaning by emanating from the aperture the optical energy having one or more optical parameters selected so as to clean a selected contaminant from the fabric material. The portable cleaning appliance can include a work surface arranged such that the work surface is in physical contact with the fabric material during cleaning or, alternatively or additionally, the portable cleaning appliance can be arranged and constructed such that that the cleaning with the optical energy is blind as to the user holding the cleaning appliance in their hand for cleaning. As an alternative to the cleaning being blind as to the user, the appliance can include a viewing window that allows the user at least some visibility of the cleaning process, wherein the cleaning appliance filters a selected wavelength or wavelengths to reduce harmful exposure of a user of the portable cleaning appliance to the selected wavelength or wavelengths.

The portable cleaning appliance can include the work surface arranged such that the work surface is in physical contact with the fabric material during cleaning. The portable cleaning apparatus can be arranged and constructed such that that the cleaning with the optical energy is blind as to the user holding the cleaning appliance in their hand for cleaning. The portable cleaning appliance can be constructed and arranged so as to include a viewing window that allows the user at least some visibility of the cleaning process wherein the cleaning appliance filters a selected wavelength or wavelengths to reduce harmful exposure of a user of the portable cleaning appliance to the selected wavelength or wavelengths.

In certain aspects of the invention, the portable cleaning appliance can include the work surface arranged such that the work surface is in physical contact with the fabric material during cleaning and the cleaning is blind as to the user holding the cleaning appliance in their hand for cleaning. The portable cleaning appliance can include the work surface arranged such that the work surface is in physical contact with the fabric material during cleaning and can be constructed and arranged so as to include a viewing window that allows the user at least some visibility of the cleaning process wherein the cleaning appliance filters a selected wavelength or wavelengths to reduce harmful exposure of a user of the portable cleaning appliance to the selected wavelength or wavelengths.

In other aspects of invention, the work surface can substantially surround the aperture. The work surface can be adapted for contacting and surrounding the fabric material such that substantially no stray optical energy escapes from the cleaning process when the contact is maintained with the fabric material. The portable cleaning appliance can include a proximity sensor arrangement for providing control of the emanation of optical energy for cleaning from the aperture responsive to the proximity of the fabric material to the aperture. The portable cleaning apparatus can be adapted and constructed such that substantially no optical energy for cleaning emanates from the aperture unless selected physical contact is maintained between the surface and the fabric material.

In further aspects of the invention, a portable cleaning appliance can be adapted and constructed such that it only operates to clean the fabric material when oriented substantially horizontally. The portable laser appliance can be adapted and constructed for delivering a vapour to the fabric material. The vapour can comprise steam. The portable laser apparatus can be further adapted and constructed to deliver a liquid to the fabric material. The portable cleaning appliance can be adapted and constructed for removing creases or wrinkles from the fabric material.

The portable cleaning appliance can include a heat source in thermal communication with the work surface wherein the appliance transfers thermal energy to the fabric material via conduction. The portable cleaning appliance can comprise a sole plate for ironing the fabric material for the removal of creases or wrinkles from the fabric material. A portable cleaning appliance can be adapted and constructed to prevent emanation of the optical energy from the aperture for cleaning unless the sole plate is positioned so as to be substantially horizontal. A portable cleaning appliance can be adapted and constructed to apply a vacuum to the fabric material. A portable cleaning appliance can be adapted and constructed to function as a vacuum cleaner for removing particular matter from the fabric material using airflow.

In additional aspects of the invention, the portable cleaning appliance includes the source of optical energy. The source of optical energy can be disposed within the appliance body. The source of optical energy can comprise a first source of optical energy that is separate from the appliance body, and the portable cleaning appliance can include a length of optical fiber in optical communication with the first optical source for delivering optical energy from the first source of optical energy to the appliance body. The first source of optical energy can comprise the source of optical energy. The first source of optical energy can comprise an optical pump source for optically pumping the source of optical energy. The source of optical energy can be integral with the appliance body. The source of optical energy can comprise an optical amplifier for amplifying the optical energy.

In further aspects of the invention, the fabric material comprises a practical fabric material. The fabric material can comprise an article of clothing. The fabric material can comprise upholstery. The fabric material can comprise a rug. The selected contaminant can comprise an organic material. The selected contaminant can comprise an inorganic material. The portable cleaning appliance can be of a size and weight such that it can be readily spatially oriented in any direction with a single hand.

In other aspects of the invention, an optical parameter or characteristic of the optical energy selected for cleaning can comprise a first wavelength of the optical energy, where the first wavelength is in the range of about 200 nm to about 750 nm. An optical parameter of the optical energy selected for contaminant removal can comprise a selected wavelength of the optical energy, where the selected wavelength is in the range of about 750 nm to about 2,500 nm. An optical parameter or characteristic selected for contaminant removal can comprise a first selected wavelength of the optical energy, where the first selected wavelength is in the range of about 2,500 nm to 10,000 nm.

In more aspects of the invention, an optical parameter or optical characteristic of the optical energy selected for cleaning can comprise the temporal characteristics of the optical energy. The optical energy can be emanated as substantially continuous wave (CW) optical energy. The optical energy can be emanated as repetitive bursts of CW optical energy or as CW optical energy emanated responsive to the user of the portable cleaning appliance. The optical energy can comprise pulses having a time duration of less than 1 picosecond. The optical energy can comprise pulses having a time duration of less than 100 picoseconds. The optical energy can comprise pulses having a time duration of less than 1 nanosecond. The optical energy can comprise pulses having a time duration of less than 10 nanoseconds.

The optical energy can comprise pulses having a time duration of less than 100 nanoseconds.

An optical parameter or characteristic of the optical energy selected for cleaning can comprise pulsing the optical energy to provide pulses having a pulse energy of more than 10 nanoJoules. An optical parameter of the optical energy selected for contaminant removal can comprise pulsing the optical energy to provide pulses having a pulse energy of more than 1 microJoule. An optical parameter of the optical energy selected for contaminant removal can comprise pulsing the optical energy to provide pulses having a pulse energy of more than 10 microJoules. An optical parameter or characteristic of the optical energy selected for contaminant cleaning can comprise pulsing the optical energy to provide pulses having a pulse energy of more than 100 microJoules. An optical parameter of the optical energy selected for contaminant removal can comprise pulsing the optical energy to provide pulses having a pulse energy of more than 1 milliJoule.

A cleaning appliance, such as a portable cleaning apparatus (or any cleaning apparatus, such as a convention washing machine) can be adapted and constructed such that one or more of the cleaning parameters (e.g., optical parameters in the case of cleaning appliance using optical energy) are selectable and changeable by the user of the cleaning appliance. However, such selection and change can also be an automated process making use of a built-in processor whose software or firmware can be upgraded over time to optimise the performance of the appliance based on new information, new understanding, development of new materials, dyes, stains and cleaning and stain removal detergents.

The invention has many aspects, including methods noted above. Some other methods are now described in more detail.

In one aspect, a method of cleaning a material can comprise applying optical energy to fabric material, the optical energy having one or more optical parameters selected so as to clean a selected contaminant from the fabric material; and removing creases or wrinkles from the fabric material and/or assisting in the cleaning of the material. Removing the creases or wrinkles can comprise applying one or more of the following to the fabric material: a vapour; a liquid; mechanical pressure; or thermal energy to heat the fabric material. Aiding in the cleaning of the fabric material can comprise applying one or more of following to the fabric material: a vapour; a liquid; mechanical pressure; or thermal energy.

Alternatively, removal of wrinkles or creases can be attained without additional thermal energy, whereby the presence of moisture in conjunction with local heat due to absorption of optical energy results in the creation of steam within the fabric. A heavy sole plate typical in most steam irons will then assist in the removal of the wrinkles and/or creases. This has the added benefit in reducing the electrical energy required for ironing clothing or textile items, removing the need for an inefficient electrical heating system to generate steam and heat the sole plate of the steam iron. A simple iron, could in effect become an iron that uses optical energy to heat the liquid applied to the substrate and/or the substrate itself, such as for removing wrinkles, independent of any process of cleaning using optical energy.

Regarding removing wrinkles or creases or aiding in cleaning, in various aspects of the invention any of the vapour, liquid, mechanical pressure or thermal energy can be applied alone or in any combination (e.g., vapour alone, liquid alone, mechanical pressure alone, or thermal energy alone; vapour and liquid; vapour and mechanical pressure; vapour and thermal energy; liquid and mechanical pressure; liquid and thermal energy; mechanical pressure and thermal energy; vapour, liquid and mechanical pressure; vapour, liquid and thermal energy; vapour, mechanical pressure and thermal energy; liquid, mechanical pressure and thermal energy; vapour, liquid, mechanical pressure, and thermal energy).

Regarding any of the foregoing, the application can be made in any order as part of the cleaning or wrinkle/crease removing process, including simultaneously with each other or with an application of the optical energy for cleaning or with an application being made before or after others or before or after an application of optical energy for cleaning.

Typically the thermal energy is applied via conduction, such as from a heated work surface in physical contact with the fabric material. The work surface can apply the mechanical pressure. However, radiation and convection are also within the scope of the invention. Thermal energy can be applied to the substrate via application of optical energy from the optical energy source, such as a laser source, alone in combination with other sources of thermal energy. The source of optical energy can facilitate removing wrinkles or creases. The optical energy can heat and/or vaporize a liquid, such as water, delivered to the substrate. The optical energy can be used to create steam.

In one aspect of the invention, removing creases or wrinkles from the fabric material and/or assisting in the cleaning of the material comprises removing creases or wrinkles. In another, removing creases or wrinkles from the fabric material and/or assisting in the cleaning of the material comprises assisting in the cleaning of the fabric material.

In additional aspects of the invention, applying one or more of a vapour; a liquid; mechanical pressure; or thermal energy to heat the fabric material comprises applying the vapour to the fabric material. The vapour can comprise steam. Applying one or more of a vapour; a liquid; mechanical pressure; or thermal energy to heat the fabric material can comprise applying the liquid to the fabric material. The liquid can comprise water. The liquid can comprise a cleaning agent, such as a detergent.

In yet further aspects, other than ambient atmospheric pressure can be applied to the fabric material, such as less than ambient atmospheric pressure or more than ambient atmospheric pressure to the fabric material. The method can be practiced "blind", that is, wherein the area being cleaned with the optical energy is not visible to the user while the optical energy is being applied to the area. The method can comprise slidingly contacting the fabric with a surface during the cleaning of the fabric material. The optical energy can be applied to the fabric material as a beam and the surface can substantially surround the beam.

The method can comprise ironing the fabric material and the application of any of the vapour, liquid, mechanical pressure or thermal energy can be part of the ironing process.

First and second are used herein as identifiers; the use of "first" does not necessarily mean there must be a "second", nor does the use of "second" mean there must be a "first".

Optical energy can be characterized by a number of optical parameters, and the portable cleaning apparatus can be adapted and constructed to provide optical energy having one or more of the parameters selected to clean a particular contaminant from a particular fabric material. Certain examples are given above. By way of further example and not limitation, useful optical parameters can include the spatial intensity profile or distribution of the optical energy (e.g., Gaussian, substantially flat topped, fluence, or other feature related to the a spatial intensity profile or distribution); spectral makeup (wavelength or wavelengths); the relative intensities of the spectral components; spectral bandwidth and any spectral chirp (the foregoing can typically be ascertained by spectral intensity profile of the optical energy); average power; temporal intensity profile (e.g., CW, pulsed, quasi CW, particular pulse train, or other type of temporal profile). Where the optical energy is pulsed, the parameters can include pulse energy, peak power, pulse duration, pulse shape (e.g., shape of the temporal intensity profile), repetition rate, duty cycle, as well as pulse train characteristics (e.g., a pulse train of pulses having different optical parameters). The location of an image plane relative to the surface of the fabric material (e.g., above the surface, substantially at the surface, or below the surface) is yet another example of an optical parameter that can be selected.

Unless otherwise defined, time durations, such as pulsewidths, and bandwidths as specified herein are full width, half maximum (FWHM) time durations and bandwidths.

"Laser", as that term is used herein, can include a structure (e.g., a fiber laser) having a resonant cavity, a master oscillator power amplifier (MOPA) arrangement (e.g., diode oscillator with a fiber or bulk optic amplifier); a diode laser; an ASE source; or a supercontinuum source. A source of optical energy as referred to herein need not comprise a laser—a high power lamp may be suitable in certain practices of the invention, most likely with appropriate filtering to select desired wavelengths. A laser, however, is typically preferred, as lasers can more readily provide optical energy confined to a small space and therefore ensure a high optical intensity at the substrate (e.g., fabric material) for improved efficiency of the cleaning process. A cleaning appliance as disclosed above, such as a cleaning appliance, can be adapted and constructed to be portable and/or hand held.

"Fabric material" is typically (but need not be) a woven, knitted or felted material, and can include a textile. A fabric material may comprise textile fibers, such as, for example, one or more of (alone or in any combination) man-made fibers such as nylon, cellulose acetate, polyester and or naturally occurring fibers such as cotton and wool. A fabric material may be primarily for practical use. Such a fabric material is referred to herein as "practical fabric material" and includes, for example, articles such as clothing, rugs, upholstery, bed sheets, towels, wash cloths, table cloths, handkerchiefs, shower curtains, window drapes, pillow covers, and quilts, which are just some examples. As used herein the term "practical fabric material" is intended to exclude works of art intended substantially only for viewing (e.g., exclude the painted canvas of a framed picture).

A fabric material may be for sustained human contact, where sustained means not transient or unexpected or unusual, but typically expected and anticipated as usual by the designer or creator of the fabric. However, sustained human contact need not necessarily be continuous or by the same person, and not necessarily direct skin contact. For example, a rug is an example of a fabric that would receive sustained human contact, but typically by many different people and typically via their footwear. The painted canvas would typically not undergo sustained human contact. Most or many practical fabric material would undergo sustained human contact. Fabric materials can be conforming fabric materials—that is, they can comprise a flexible material that readily conforms to an object they are draped over or that is manufactured to conform to a subject or object (e.g., a shirt or a car cover).

"Blind as to the user" means that the when the portable cleaning appliance is in use to clean a workpiece, the area being cleaned by the optical energy is not under normal and anticipated use directly visible to the user of the appliance. "Directly visible" does not include video camera/screen arrangements (such are used in optical splicers, for example). Such arrangements do not provide for direct vision. The wearing of laser goggles to view a cleaning process does, as the term is used herein, mean the process is directly visible. "Appliance" is used interchangeably with "apparatus" herein. "Within the appliance body" refers to the volume within the overall outermost surface of the appliance.

"Oriented substantially horizontally" means that the central axis of a beam of optical energy emanating from the portable cleaning appliance is substantially perpendicular to the horizontal plane (which is taken as level), that is, with about 15 degrees of the vertical axis that is perpendicular to the horizontal plane.

"Stray optical energy", as that term is used herein, refers to optical energy that propagates such that it can be incident on something other than the subject of the cleaning process (e.g., the fabric material), such as the user of the portable laser appliance, or a bystander. Stray optical energy is undesirable and can be created even when the portable laser cleaner is orientated such that the optical energy is directed at the fabric material. Creation of stray optical energy can involve one or more of a number of processes, such as scattering, reflection, refraction, or diffraction. In a perfect cleaning process (from the perspective of safety) no optical energy would emanate from the laser appliance except directly at the workpiece, and that optical energy would do its cleaning job without creating any stray optical energy, so that no optical energy could be incident on the user or a bystander.

Several aspects of the invention are described above, in varying detail as to the features of each of the aspects. Any of the features of one of the aspects can be included as an additional or alternative feature of any of the other aspects, practices or embodiments of the disclosure described herein, except where clearly mutually exclusive with another feature of an aspect, practice or embodiment or where a statement is explicitly made herein that certain features will not work in such a combination. To avoid undue repetition and length of the disclosure, every possible combination is not explicitly recited. Furthermore, as the skilled worker can ascertain, a method of the present disclosure can comprise the steps relating to the function or operation of the features of apparatus and systems disclosed herein.

BRIEF DESCRIPTION OF THE DRAWINGS

FIG. 20 shows an example of a cotton fabric having been contaminated with a dark oil from an engineering workshop and subsequently cleaned using a pulsed laser beam;

FIGS. 21*a* and 21*b* illustrate the laser cleaning of a food stain from a cotton shirt;

DETAILED DESCRIPTION

Figure 1:
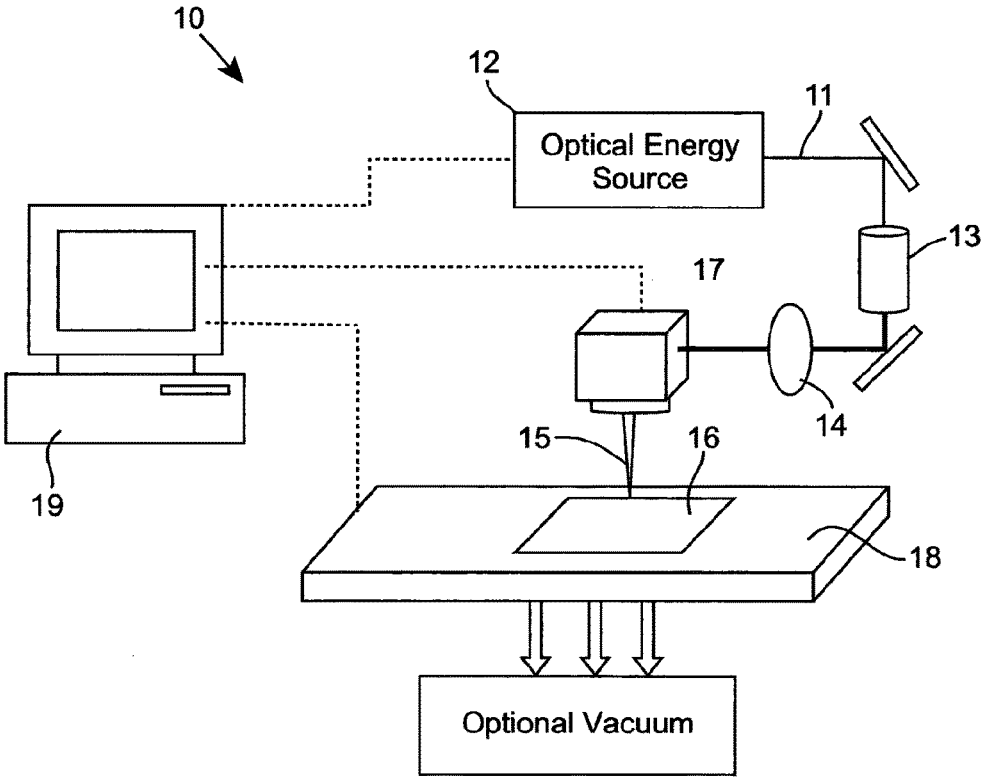
FIG. 1 schematically illustrates one embodiment of an apparatus according to the present invention for cleaning a substrate using optical energy from a laser whereby the beam and/or the substrate can be translated.

FIG. 1 illustrates one embodiment of an apparatus 10 for cleaning of a substrate, such as, for example, a practical fabric material. The apparatus 10 comprises an optical transmission pathway arranged for propagating optical energy received from a source of optical radiation for emanation of the optical energy for the cleaning of the substrate, and which in the embodiment of FIG. 1 can comprise a beam expander, focussing lens and scanning head. For example, the optical output beam 11 from the source of optical energy, which preferably comprises laser source 12, is beam shaped using a beam expander 13 and focussing lens 14 into a focussed beam 15 at the surface of a substrate 16. The beam can be scanned over the substrate surface using a laser beam scan head 17 and the substrate can be scanned with respect to the focussed beam using an x-y or x-y-z axes translation stage 18. Typically the laser, scan head and translation stage are controlled by a computer 19 (a processor could be used as well, without one or more of the typical features of a computer) to determine the location, timing, and power level at which the laser radiation is delivered to the substrate. The beam 15 can be focussed to a small spot to enhance the optical intensity of the beam at the substrate surface, and scanned for cleaning a selected area of the surface of the substrate. In one example considered to effect cleaning of a fabric material, the laser source can comprise a pulsed fiber laser delivering short pulses of approximately 20 nanoseconds in duration at an average power of 20 W and pulse energy of up to 800 μJ at a wavelength of 1064 nm. The fabric material can be dampened with water to aid the cleaning process. In another example considered to effect cleaning of a fabric material, the laser source can comprise a pulsed diode pumped solid state laser delivering pulses of below 200 nanoseconds at a wavelength in the visible region of the spectrum.

Figure 2:
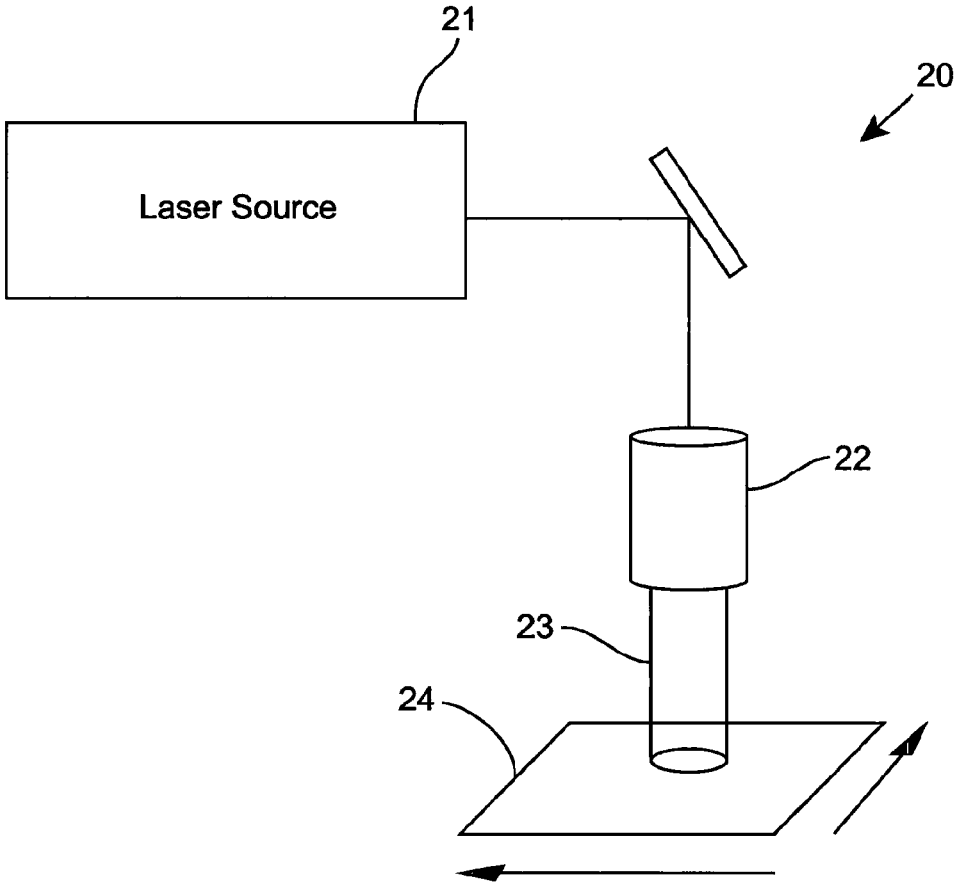
FIG. 2 schematically illustrates a configuration for beam shaping, suitable for use with any of the apparatus described or shown in the other FIGURES herein (except where clearly incompatible), whereby the beam is made into a large spot either through collimation or by diverging the beam. The large spot can provide a "flood" illumination covering a larger area of the substrate, spreading out the optical energy over a larger area.

FIG. 2 illustrates an apparatus 20 comprising an optical transmission pathway wherein the beam from a laser source 21 is shaped by beam shaping optics 22 into a larger beam or divergent beam 23 which becomes a large spot when incident on the substrate 24. Such illumination is often referred to as flood illumination, and the apparatus 10 can alternatively use such flood illumination in place of a focussed beam 15.

Figure 3:
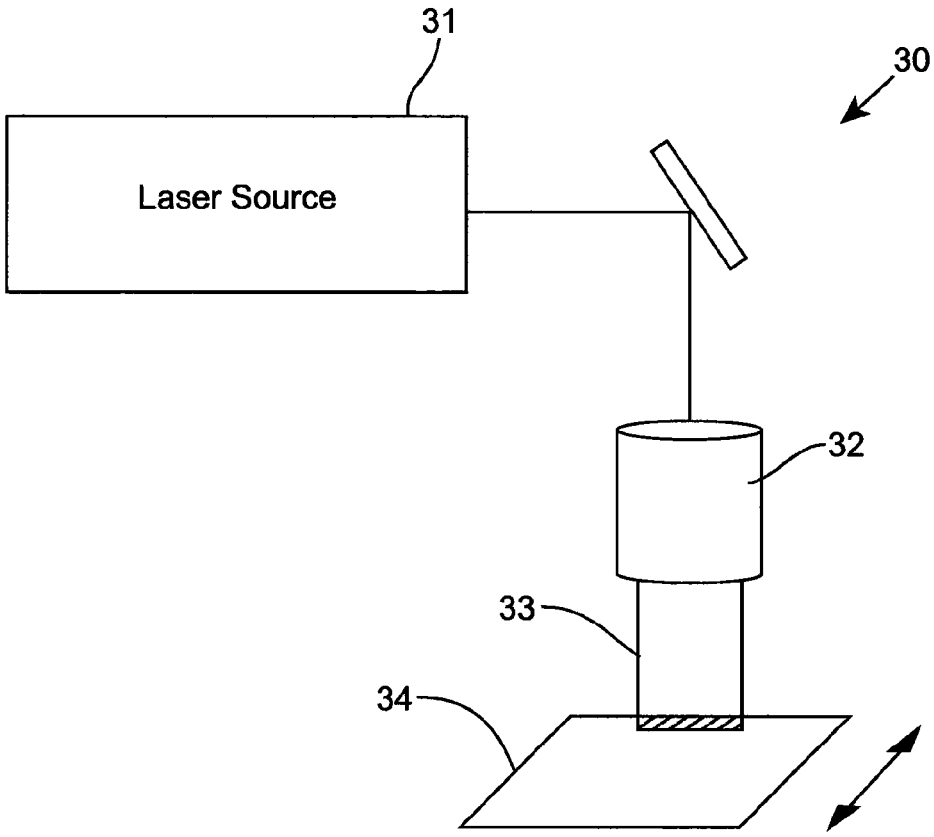
FIG. 3 schematically illustrates a configuration 40 for beam shaping, suitable for use with any of the apparatus described or shown in the other FIGURES herein (except where clearly incompatible), wherein the optical beam is shaped into a thin stripe, allowing a large area coverage in one axis, yet maintaining a high intensity of the optical field in an orthogonal axis.

FIG. 3 illustrates another apparatus 30 which depicts an optical transmission pathway that involves the shaping of a laser beam 31 by beam shaping optics 32 in the form of a cylindrical lens into an elliptical beam with a very high degree of ellipticity such that the shaped beam 33 takes the form approximating a thin stripe of light when incident on the substrate 34. Such an illumination is often referred to as line illumination, and such line illumination can alternatively be used in apparatus 10 in place of the focussed beam 15.

Figure 4:
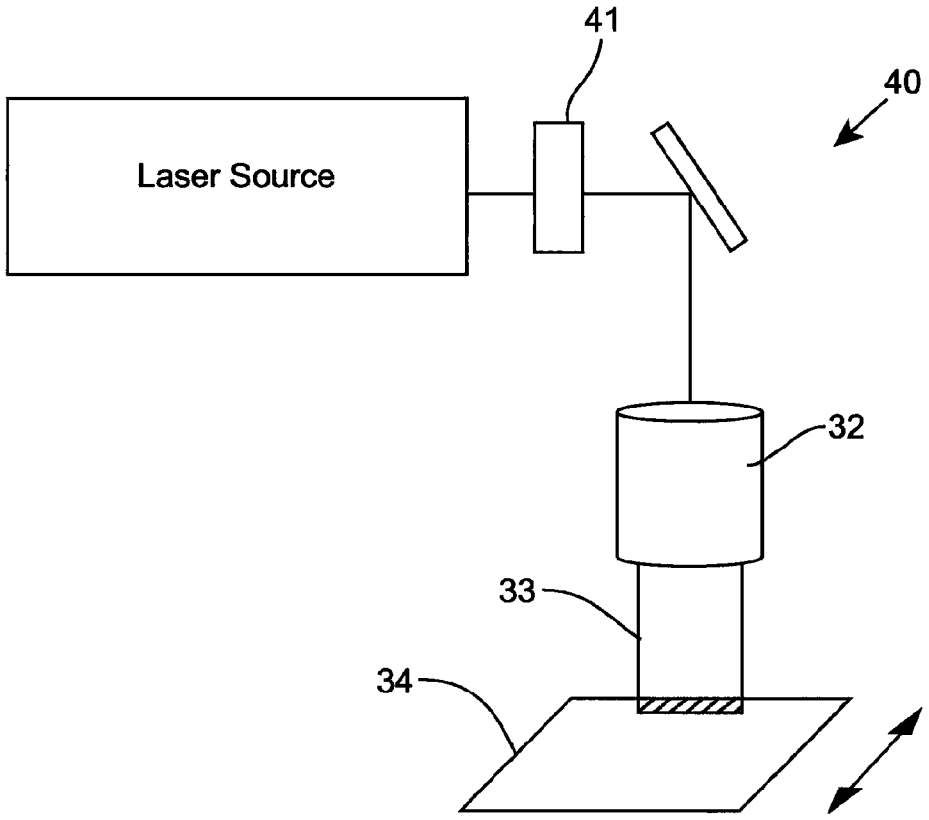
FIG. 4 illustrates a line-illumination system, suitable for use with any of the apparatus described or shown in the other FIGURES herein (except where clearly incompatible), with additional features to enhance the contaminant cleaning process, including modulation to enable pulsing or gating of the optical beam, wavelength filtration (in the case of a broadband or multi-wavelength light source) to optimise the optical wavelength for the specific contaminant or substrate, variable attenuator or power control of the light source output to control the rate of material removal or fluency of light at the substrate surface.

FIG. 4 illustrates the apparatus of FIG. 3 where the optical transmission pathway includes additional feature(s) 41 enabling one or more additional controls of the source of optical energy (i.e., the laser) including modulation of the laser in time and power, and wavelength filtration of the laser (when integrated as a broadband or multi-line laser source) to deliver the optimum wavelength for efficient processing of different material substrates. The apparatus shown in FIG. 1 can be modified according to FIG. 4, and the apparatus of FIG. 1 so configured used to clean a fabric material. Any of the embodiments discussed above or below, such as in conjunction with the FIGURES, can include one or more additional feature(s) 41 for conditioning the optical energy or beam, where the additional feature(s) can include one or more of an attenuator, modulator, filter, etc., and one or all of such feature(s) 41, and one or more of the beam expander 13 or translation stage 18 or scan mechanism can also be included in other embodiments shown or described herein, as well as controlled by a processor described above and below, where the processor can be configured for controlling the cleaning process responsive to programming and/or data (information) communicated to the processor from a user data interface. The data can be read, for example, from a data element associated with (e.g., integrated with) a substrate, as is described in more detail herein.

Figure 5:
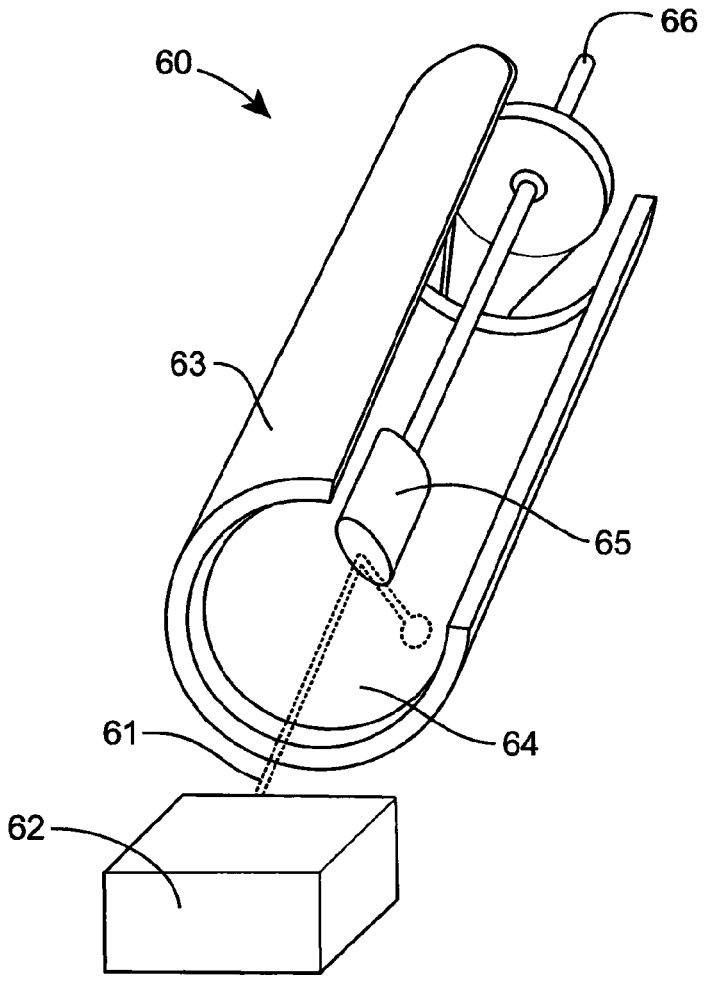
FIG. 5 schematically illustrates another embodiment of an apparatus for practicing the present invention, where the apparatus includes a rotating-drum concept similar to a conventional drum washing machine.

FIG. 5 illustrates another example of an embodiment of an apparatus 60 according to the present invention. In FIG. 5, the cleaning apparatus 60 is based around a drum arrangement. The drum can be stationary or can rotate. Here the optical transmission includes a spinning mirror. An optical beam 61 is delivered by a source of optical energy 62 along the central longitudinal axis of a drum 63, which can rotate around the longitudinal axis. The substrate to be cleaned 64 can be positioned flat on the internal surface of the rotating drum. This positioning can be attained through mechanical fixings or a suction mechanism within the drum (not shown in this FIGURE). Preferably the positioning of the substrate on the drum internal wall is attained through centrifugal forces as the drum rotates at high speed.

The spinning, scanning mirror 65 is mounted on a spindle 66 located on the central longitudinal axis of the drum, which can rotate. The optical beam is incident on the mirror which deflects the beam to be incident at the surface of the fabric material substrate on the internal drum wall. The rotation of the drum, spinning of the mirror and longitudinal translation of this mirror along the spindle over time results in the optical beam scanning the entire internal surface area of the rotating drum, attaining a complete coverage of the substrate within the drum, and cleaning the entire substrate. Repeat scans of the substrate surface can be attained by continual rotation of the drum, continual spinning of the mirror and continual translation of the mirror along the central spindle of the drum.

Further assistance to the cleaning process, as with all embodiments of the invention described herein, can include the provision of suction to clean contaminants from the drum and/or substrate, application of assistance mechanism; water, solvents, detergents, stain removers, oxygen-based bleaching agent, steam, compressed gas etc. to substrate or drum or locally as a nozzle, focussing the assistant mechanism to the incidence region of the optical beam.

The source of optical energy preferably comprises a laser. The laser can be selected on the basis of performance and cost and can be selected from a wide variety of laser types including, but not limited to, semiconductor diode lasers, fiber lasers, diode-pumped solid state lasers, gas lasers and combinations thereof. The laser source can deliver the laser light as continuous wave (CW), gated CW, pulsed or as bursts of pulses, said pulses being in the sub-picosecond, tens of picoseconds, sub-nanoseconds or greater than 1 nanosecond pulsed duration. The laser can deliver light in the infra red, near infra red, visible or UV region of the spectrum or can cover multiple regions of the spectrum as a continuous spectral band or a series of discrete wavelengths or wavelength bands. The laser, if of broadband spectral coverage, can include additional filtration to provide wavelength selection optimised to the contaminant and or substrate. These considerations can apply to all embodiments taught herein.

Figure 6:
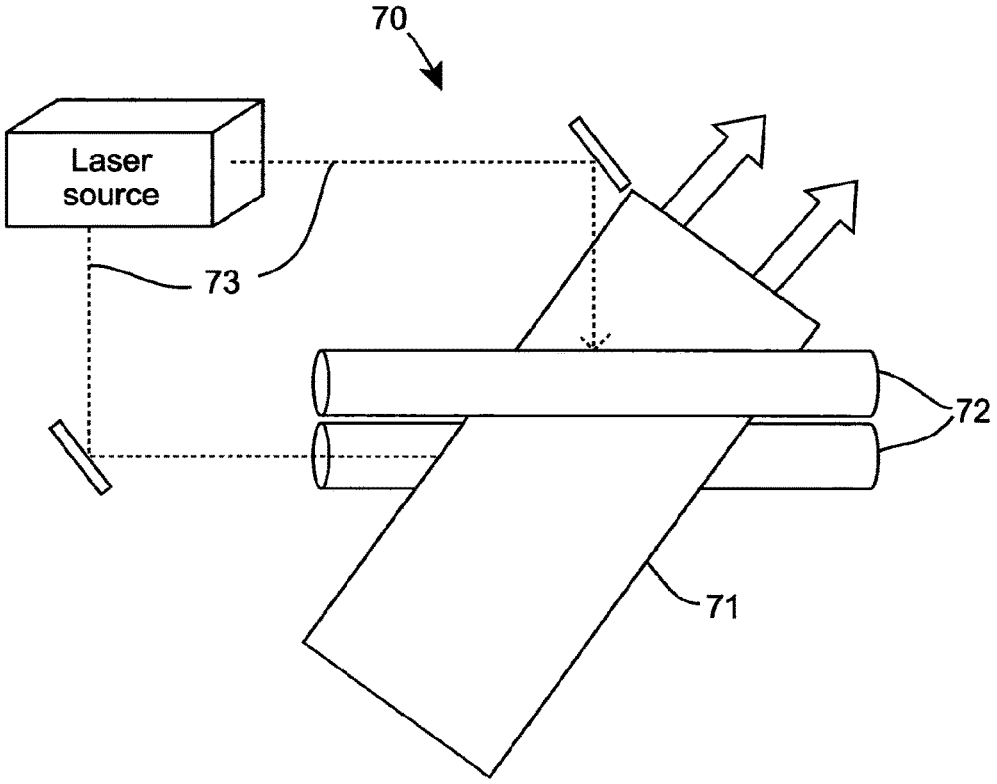
FIG. 6 schematically illustrates another embodiment of an apparatus for practicing the present invention including a "mangle-type" of design, whereby the substrate passes through the optical beam as a flat substrate.

FIG. 6 illustrates another embodiment of an apparatus 70 designed for the cleaning of a substrate comprising contaminated fabric material. The optical transmission pathway includes a mangle type structure. The contaminated fabric to be cleaned 71 is passed through a mangle 72 which is adapted to pass one or more optical beams 73 from an optical source 74 and direct them onto one or more of the substrate surfaces as the substrate is passed and forced flat, translating through the mangle space in the mangle. Optical energy can be delivered from the top, bottom, or from both the top and bottom.

As described in conjunction with FIG. 5, the beam can be focussed to a small spot or shaped into a large spot on the substrate as a collimated or divergent beam. Alternatively, the beam can be shaped into a stripe at the surface of the substrate. The beam can be fixed in position or alternatively scanned by a beam scanner.

Figure 7:
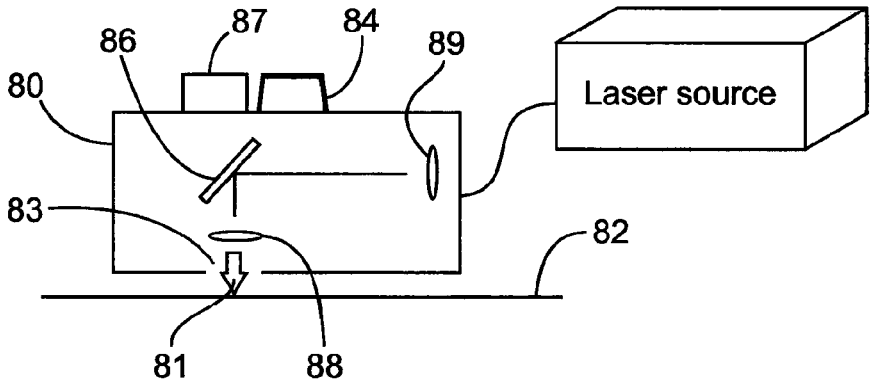
FIG. 7 schematically illustrates a further embodiment of an apparatus for practicing the present invention, wherein a beam of optical radiation is delivered to the substrate by a movable enclosure and where the source of optical energy is external to the enclosure with the optical energy delivered between the source and enclosure via an optical light guide.

FIG. 7 shows another embodiment of the cleaning apparatus for cleaning a substrate, such as a substrate comprising a fabric material, according to the present invention. In this embodiment, the cleaning apparatus is configured as a module or body 80 which can be moved with respect to the substrate, the module delivering the optical beam 81 to the substrate surface 82 preferably via aperture 83, which can comprise an optical window that is transmissive at the wavelength of the source of optical energy. In this specific exemplary embodiment, the source of optical energy is located external to the module 80 and optical energy from the optical source is delivered to the module by a light guide such as an optical fiber or light guide of the optical transmission pathway. The module can comprise the beam shaping optics 89 and beam steering optics 88 of the optical transmission pathway to focus or shape the beam to the desired parameters at the substrate surface. The beam shaping optics may produce a focussed beam, or line or broad area beam at the substrate surface. The beam steering optics may additionally comprise a scanning mirror 86 to scan the beam across the substrate surface such as to provide broad area scanned coverage of the substrate surface (such as by scanning a focussed spot over the substrate) and/or to prevent over exposure of a particular region of the substrate and the local build-up of heat due to locally-absorbed optical energy. The apparatus may include the one or more additional feature(s) 41, such as shown in FIG. 4.

The module preferably also includes a mechanism for controlling (automated or manually through user adjustment via, for example, control panel 87) various parameters of the optical beam including, but not limited to, power, pulse duration, wavelength, pulse repetition rate and beam size. One example of such a mechanism is user input 87 such as a knob or keypad.

The module can be moved around the substrate to produce wide-area coverage and cleaning of large regions of the contaminated substrate. The module can be moved by hand via a mounted handle 84 or could be mounted on a gantry or robot for more industrial, automated cleaning applications, for example in large pieces of professional cleaning equipment or within environments such as nuclear and chemical sites, where it is not possible for people to be present. The bottom of the module can comprise a work surface for contacting (e.g., slidingly contacting) the substrate as the module is moved around during the cleaning process. The work surface can surround the aperture, as shown in FIG. 7.

Figure 8:
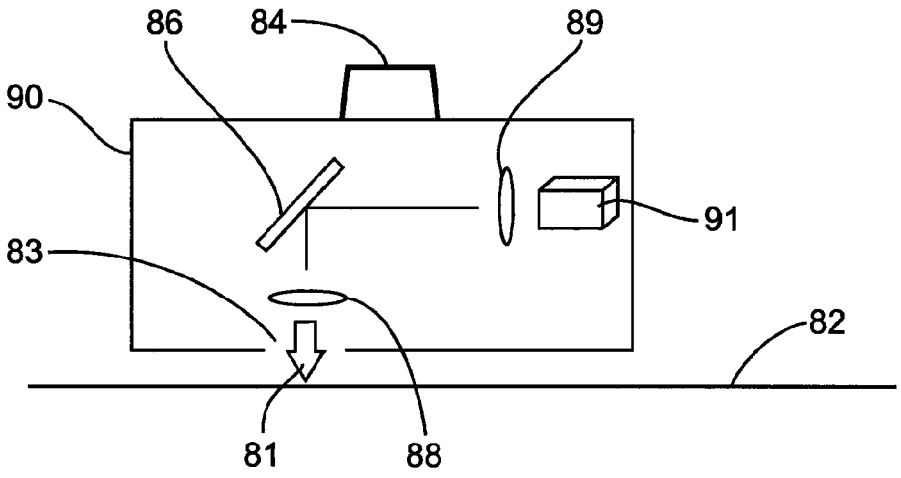
FIG. 8 schematically illustrates yet an additional embodiment of an apparatus for practicing the present invention, wherein a beam of optical energy can be delivered to the substrate by a movable enclosure and where the optical source is mounted within the enclosure.

FIG. 8 illustrates another embodiment of the present invention with the same features and variations as FIG. 7 with the difference that the optical source 91 is located within the module 90.

Figure 9:
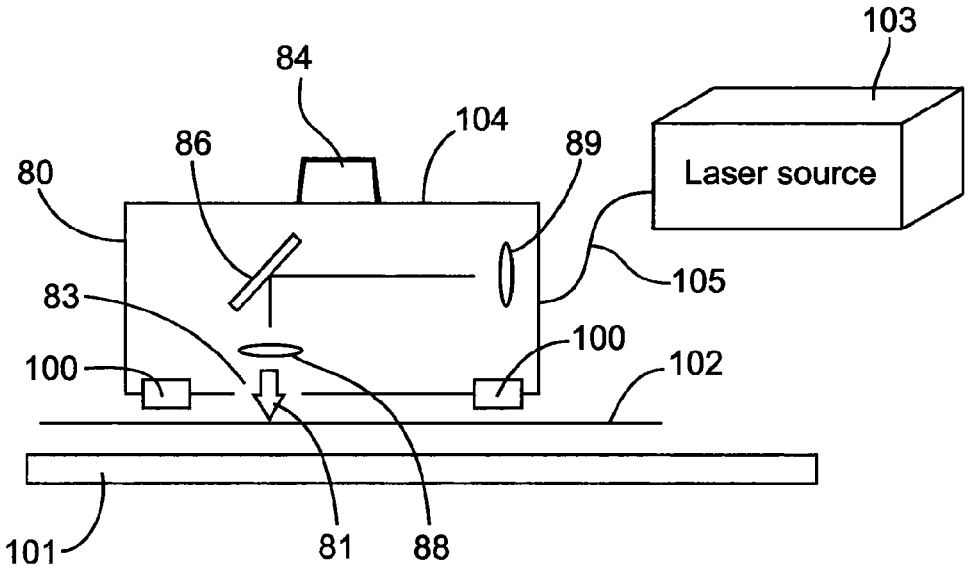
FIG. 9 illustrates the apparatus of FIG. 8, with further illustration of safety features to prevent accidental exposure of the optical beam to the user or to prevent extensive exposure of the optical energy to the substrate which might otherwise cause damage to the substrate. Safety features can include a position sensor for interlocking the laser to only allow operation of the source of optical energy where there is no possible exposure to the user's skin and/or eyes. Safety features can also or alternatively include a motion sensor which determines if the optical beam is moving with respect to the substrate or at what speed this motion exists.

FIG. 9 illustrates another embodiment of the present invention with the same features as FIG. 7 or 8 but with additional safety interlock features specifically shown by way of example (which features may apply as well to the embodiment of FIG. 8). In all embodiments of this invention, the optical source can be a laser source and, in any of the embodiments, the laser source can comprise a class 4 laser source requiring strict laser safety controls and appropriate interlocks. In order to utilise such a class 4 laser apparatus within a domestic environment, and in many industrial environments, the system should be failsafe to ensure that the user cannot be exposed to the laser beam beyond those acceptable exposure limits as governed by applicable laser safety standards. FIG. 9 gives an example of how this particular embodiment of the present invention might be implemented as a safe-to-use commercial appliance.

Referring to FIG. 9, one or more sensors 100 on the bottom of the module or body 104 can be position sensors to sense whether or not the module is flat against a surface, thereby preventing access to the light aperture of the module and exposure of the end user's skin or eyes to potentially harmful levels of optical radiation. The sensors 100 can also or alternatively be motion sensors to detect if the module or body is moving relative to the substrate and also optionally detect the speed of this movement. The motion detector can control the delivery of the optical energy to the substrate from the optical source in the event of low or no movement to control the dosage delivered to the substrate or to prevent the lengthy exposure of the substrate to the optical energy which might otherwise damage or degrade the substrate material. The motion detector can also or alternatively control the fluence of the optical energy onto the substrate dependent on the speed of translation of the body to achieve a consistent or optimised or limited exposure of the substrate to the optical energy. The sensors can be electrical, optical, magnetic, pressure or any other type of sensor. Furthermore, to make the system failsafe, the module could be designed to only work on a given platform. For example, in an industrial machine, the base plate 101 on which the substrate 102 is mounted may be fabricated from a specific material or emit a specific frequency or optical wavelength that the position sensors 100 must detect in order for the source of optical energy 103 to operate. Typically, the laser source within a commercial system would have at least one interlock and preferably two interlocks, requiring, for example, all position sensors to detect that the module is flat against a surface and that the system is light-tight, not allowing scattered optical radiation to exit from the module leading to potential user exposure. Only when position sensors are in place can the laser operate. In the specific example embodiment shown by FIG. 9, the light source 103 is located external to the module 104. In this case, additional protection would be required to detect a break in the optical delivery cable 105 with implementation of an interlock to shut down the optical source in the event of an output power failure due to optical cable break. The source of optical energy can be included with the appliance body, rather than external to the body.

It will be appreciated that the examples shown in FIGS. 1-9 can implement other mechanisms to assist (the optical source) with the cleaning process. Such additional mechanisms can include, for example, the use of water to dampen the contaminated substrate, steam to provide heat, moisture and pressure to the cleaning process, vacuum or compressed air to provide removal of any removed contaminant particles through suction or by blowing the contaminant away from the substrate, chemicals including detergents, stain removers, oxygen-based bleaching agents, or anti-oxidants which provide a chemical reaction to assist the removal of the contaminant from the fibers of the substrate textile. When assisting the cleaning process using a chemical such as a detergent, the detergent can comprise surfactants, enzymes, oxygen-based bleaching agents, builders, optical brighteners and other ingredients of commercial detergents. The detergent can contain less than 5% of the oxygen-based bleaching agent. The detergent can contain more than 5% of the oxygen-based bleaching agent. The detergent can contain more than 15% of the oxygen-based bleaching agent. The detergent can contain more than 30% of the oxygen-based bleaching agent. The percentages can be by weight. When including a chemical to assist in the cleaning process, the optical energy from the optical source can provide localised heat which increases the effectiveness of the chemicals such as detergent, enzyme and bleaching agent. The optical energy can also increase the mobility of the contaminant molecules making them easier to react with the chemical and clean from the substrate.

The modules shown in FIGS. 7-9 represent a cleaning tool for substrates, and in particular substrates comprising a fabric material, which can be hand held or mounted on an automated mount such as a gantry or robot.

FIGS. 10-15 show hand-held modules, such as those described above in FIGS. 7-9, with the modification that the modules are now further configured as an iron, such as a steam iron for use, for example, in the domestic and commercial ironing of fabric materials. The "Light Iron" is hereby referred to as a LIRON for the purposes of this invention. FIGS. 10-15 show examples of how the cleaning apparatus can be combined with other mechanisms which assist with the cleaning process. FIGS. 10-15 further show how the laser cleaning apparatus can be designed to be combined with other functions such as crease or wrinkle removal, typically attained with a conventional iron, steam iron or steam generator iron. One or more of the features shown in FIGS. 10-15 can be included, alone or in any combination, in the embodiments shown in FIGS. 7-9.

A traditional iron or steam iron or more recently steam generator iron, is used to remove creases from fabric materials, most commonly clothing and household textiles including bed sheets, table cloths etc. Most commonly, the iron is in the form of a steam iron, including not only heat but also a water sprayer and source of steam to help with the ironing process. The steam iron uses superheated water to eliminate wrinkles in clothes and fabrics which may not be suitable for traditional dry ironing. Distilled water is usually poured into a holding tank and special heating elements convert it to steam. This hot mist comes out through a number of holes in the soleplate or bottom plate, which typically is heated by a source of thermal energy (e.g., an electric heating element) of the steam iron. As the steam loosens the individual fibers of the clothes, the steam iron's pressing action smooths out wrinkles or creases.

Ironing is a process carried out typically after washing and drying fabric materials. It is an additional task in the home and is required in most cases to remove creases and wrinkles, though some "non-iron" fabrics are available where limited ironing is required.

FIGS. 10-15 show examples of a hand-held cleaning tool for fabrics (substantially similar to those shown in FIGS. 7-9, with the differences now shown or described). However, the invention described by way of example in FIGS. 10-15 also have the option to provide or enhance the function of crease or wrinkle removal in addition to the cleaning capability. In many cases, an item of clothing or a table cloth, bed sheet, etc., might have very light soiling yet is cleaned on a regular basis. An example is a shirt worn by a typical office worker. This shirt may be worn once per day, after which it is cleaned in a conventional washing machine and then ironed to remove the creases. In actual fact, the shirt will have very minor amounts of dirt around the collar and cuffs, perhaps a localised food stain and regions of odour from the wearer's body. The abrasive washing nature of a conventional drum-machine is not required to clean this item of clothing, yet this is the only solution. The hand-held cleaning system shown by way of example in FIGS. 7-9 and the LIRON system shown by way of example in FIGS. 10-15 provides a tool to clean such items of clothing, to remove dirt, odours and stains and, if necessary, to achieve this process whilst simultaneously removing the creases from the textile (item of clothing).

Figure 10:
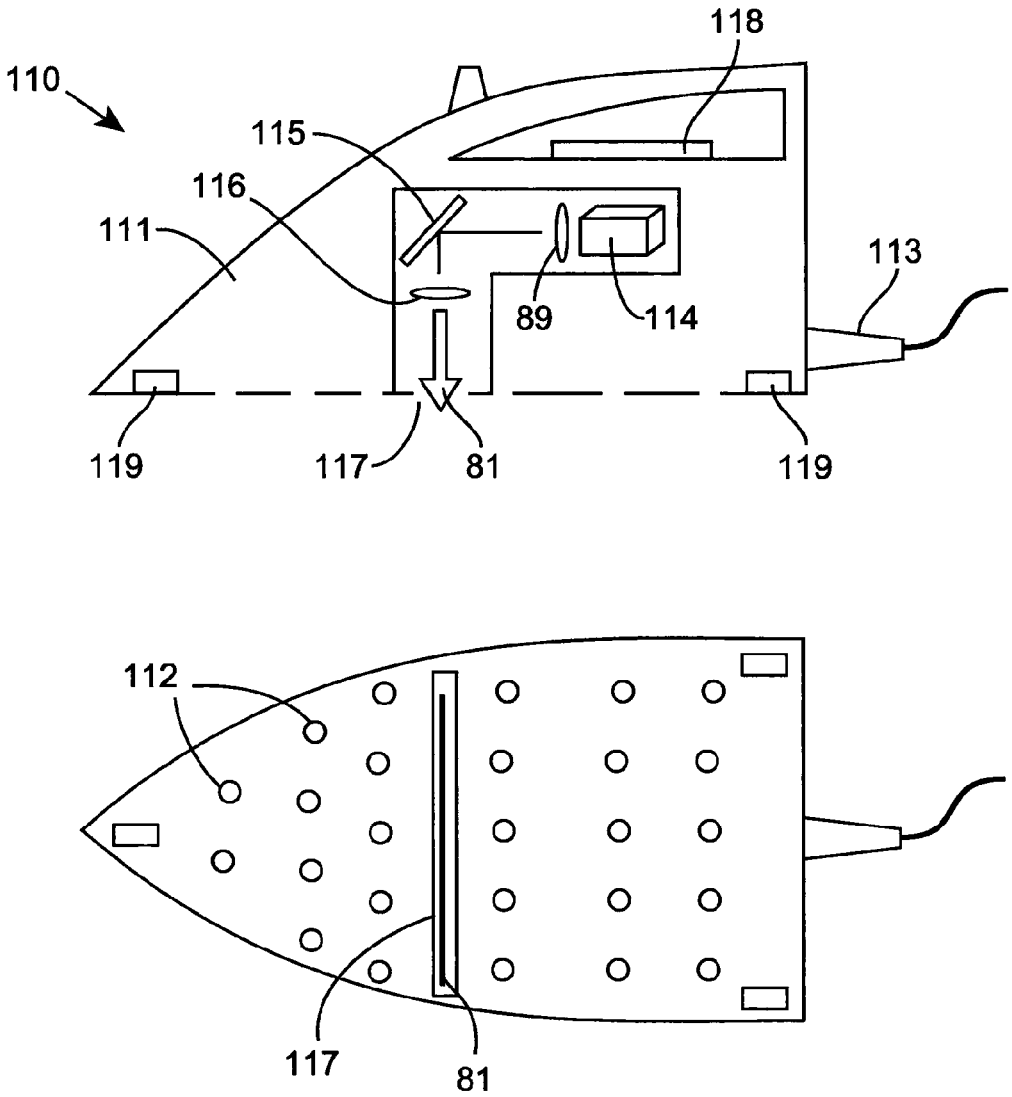
FIG. 10 schematically illustrates one embodiment of an apparatus for practicing the present invention in the form of a Light (or Laser) Iron (LIRON™)

Referring to the specific FIGURES and embodiments of the invention, FIG. 10 shows one such example of a hand-held light cleaning apparatus implemented as an iron. The LIRON 110 can comprise one or more of all the features of a traditional steam iron, including, but not limited to a body, a heat generator and heat control via thermostat and user control 118, steam generator and water reservoir 111, water sprayer, holes in the base 112 to allow steam to be directed onto the substrate textile, power cable 113 etc. The bottom surface of the base can be a work surface, such as work surface for slidingly contacting the fabric material during the cleaning thereof. In addition, the LIRON contains a source of optical radiation 114 and an optical transmission pathway between the source of optical energy and an aperture for emanating the optical energy for cleaning the substrate. The optical transmission pathway can comprise beam steering optics, 115, beam shaping optics 116 for conditioning and/or propagating the optical energy to aperture 117, which can include a transmissive optical window. In this specific example, the beam shaping optics form the output of the source of optical energy into a narrow stripe covering the width of the optical window of the base of the apparatus. This apparatus would typically include power control of the light source as well as control of other features including the pulse duration or duration of optical bursts provided to the substrate, the duty cycle of these bursts and other parameters of the optical output which can help optimise the process of removing contaminants from the substrate textile. Such controls would preferably be available with easy access to the user of the apparatus. The embodiment of FIG. 10 can include one or more of the additional elements 41.

Figure 14:
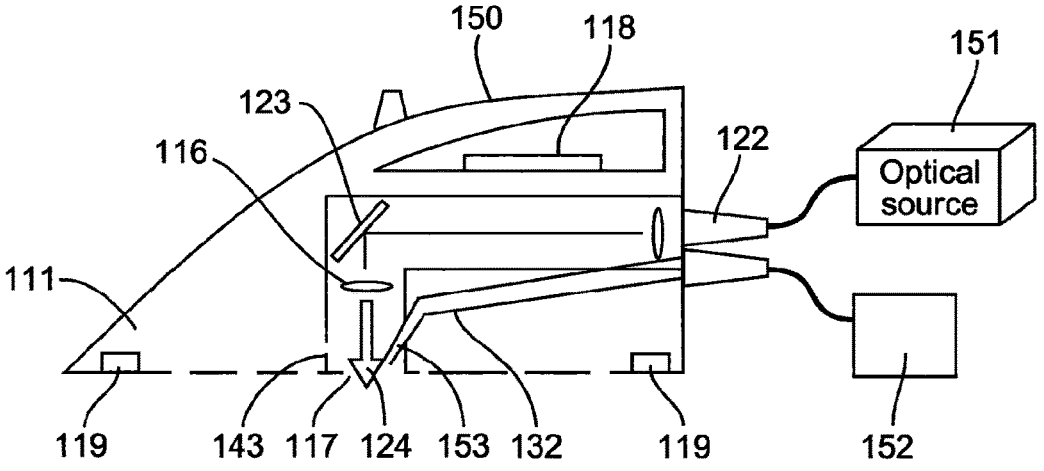
FIG. 14 schematically illustrates another embodiment of a LIRON apparatus, in this instance including an external suction pump or vacuum to assist in the removal of contaminant from the substrate and optional microprocessor and data port.

One possible implementation is shown in FIG. 10 as a knob (or touchpad) 118 on the LIRON. The specific control settings may be dependent on the type of fabric material and can be pre-set and calibrated such that the user simply sets the apparatus operating parameters dependent on the textile type (cotton, wool, synthetic etc) and/or contaminant type (stain, blood, wine, oil, grease etc). Alternatively, the control settings can be set and altered by a microprocessor on board or external but connected to the apparatus (for purposes of illustration, an internal processor is shown in FIG. 14, and can be included in FIG. 10 as well). The control settings can be set for a given substrate material, contaminant type, garment type or brand, detergent or chemical type or brand. The settings can also be adjusted live throughout the cleaning process through feedback of the speed of motion of the apparatus with respect to the substrate or even by measurement of the amount of contaminant being cleaned from the substrate. The settings can be pre-set for a range of garments, substrate types or detergent type or alternatively the settings can be optimised for a given garment, brand of clothing, detergent, brand of detergent and the settings uploaded onto the microprocessor by means of a suitable communications means such as a USB, RS232, wireless port or via a scanner such as a bar-code scanner.

The control settings can be upgraded, as described elsewhere. Also shown in FIG. 10 are a series of sensors 119 which can be position sensors and/or motion sensors and are used as a safety feature and/or a feature to prevent damage to the substrate due to excessive optical exposure. The sensors are useful if the optical output of the apparatus exceeds the legal limits for safe human exposure. Such position sensors are linked to safety interlocks for the optical source and allow operation of the source only when the apparatus is in a safe position whereby no light leakage and optical exposure to the user is possible, as described in conjunction with FIG. 9.

Figure 11:
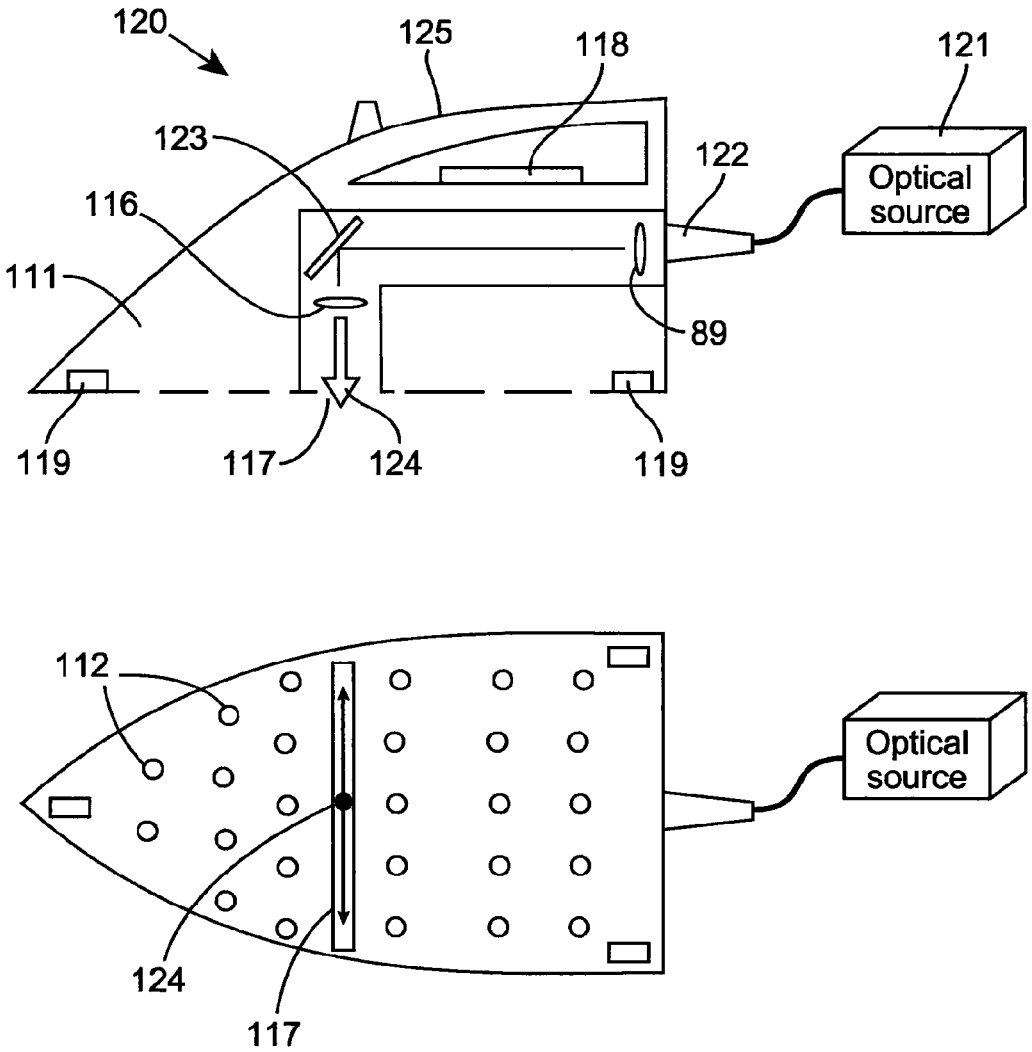
FIG. 11 schematically Illustrates another embodiment of the LIRON 120, with the source of optical energy 121 mounted external to the LIRON body and the beam being delivered to the hand held LIRON via optical cable 125. The beam in this example is shown as a focussed spot which can be fast-scanned horizontally over the width of the LIRON base or sole plate.

FIG. 11 schematically illustrates another embodiment of the LIRON 120, substantially similar to FIG. 10 except with the following differences. In this embodiment, the optical source (otherwise referenced to herein as source of optical energy) 121 is positioned external to the apparatus body 125 with the optical transmission pathway comprising a flexible optical light guide such as an optical fiber. Beam shaping optics 122 and beam steering optics 123 optimise the shape and position of the light beam at the output aperture on the base of the apparatus. In this example, the beam is focussed to a small spot 124 at the aperture to optimise the intensity of the beam at the substrate to be cleaned. The beam steering optics include a scanner which scans the focussed beam from side to side along the light aperture window shown (by way of example only) as a thin window in this example. The scanning speed is preferably arranged to be fast such that the focussed spot does not dwell for a long period at any one spot, potentially leading to heat build-up locally in the substrate. In some embodiments, the reservoir 111 can include compressed air or a pressurized aerosol.

Figure 12:
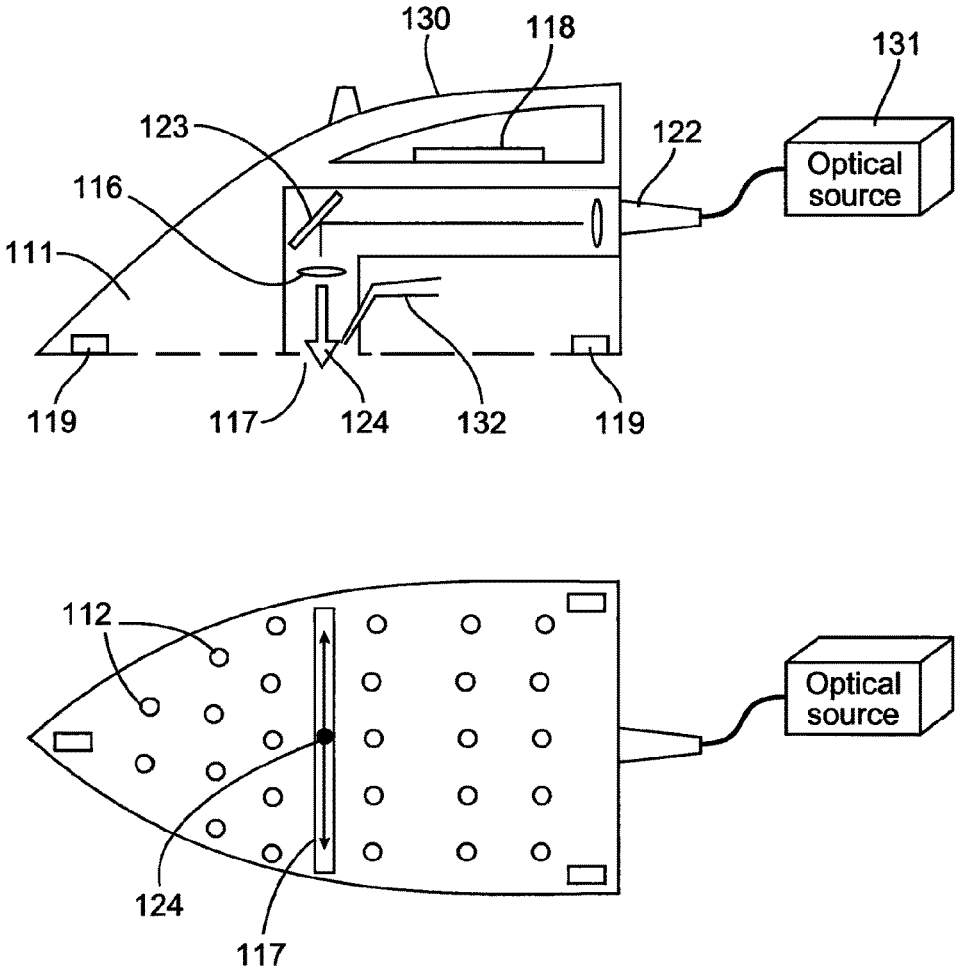
FIG. 12 schematically illustrates another embodiment of the LIRON apparatus, similar to that of FIG. 11, where the LIRON is adapted and constructed for providing steam, water, or air to the substrate exposed to the optical energy. Delivery of steam, air, etc., can assist in the removal of the contaminant from the substrate, and can be simultaneous with, or before or after, an application of cleaning optical radiation to the substrate.

FIG. 12 schematically illustrates another embodiment of the LIRON, which can be substantially similar to FIG. 11 with the differences now described. In this example, the optical source 131 is also positioned external to the apparatus 130 with the light delivered to the apparatus by a flexible optical light guide 133 such as an optical fiber. It will be appreciated that the optical source could be equally positioned within the apparatus, as shown in FIG. 10. The apparatus is identical to the example embodiment of FIG. 11 with the addition that there is provided a mechanism such as the opening of a nozzle 132 for directing steam (this could also be water, air, gas, detergent, oxygen-based bleaching agent, stain remover or other assistant mechanism or cleaning agent for the optical cleaning process) locally at the substrate where the optical beam is incident at the substrate. The locally focussed steam or gas can assist in the removal of contaminant from the textile by providing thermal energy to the process or simply by applying a pressure to "blow-away" contaminant particles removed from the textile fibers by the optical beam and any assistant mechanism. The apparatus can include a reservoir in fluid communication with the opening. In some embodiments, the reservoir 111 can include compressed air or a pressurized aerosol.

Figure 13:
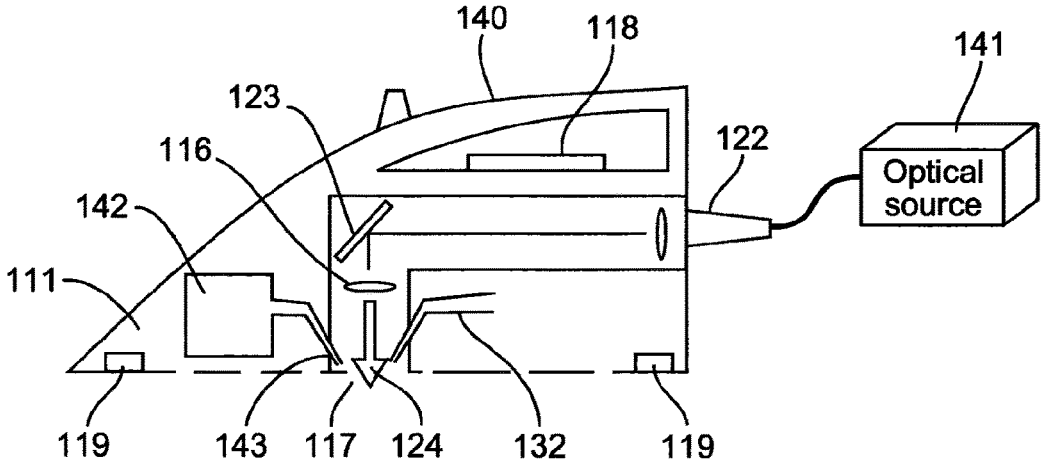
FIG. 13 schematically illustrates yet another embodiment of a LIRON apparatus for practicing the present invention, where the LIRON includes a suction pump or vacuum to assist in the removal of contaminant from the substrate and the suction or vacuum pump may be integral with the LIRON apparatus.

FIG. 13 shows yet a further example embodiment of the LIRON apparatus, again with the optical source 141 external to the apparatus 140 (and again the source of optical energy can be included within the body, as shown in FIG. 10). The apparatus of FIG. 13 is identical to that shown in FIG. 12 with the addition of a vacuum or suction pump 142 within the apparatus, such suction being directed by a nozzle 143 locally to the substrate in the region where the optical beam cleans contaminants from the substrate. The suction pump serves to extract debris or contaminants or cleaning agent, which can include such contaminants, from the substrate, which are often removed or dislodged from the textile fibers by the cleaning process, such as by the optical beam and any assistant mechanism. In the case where a chemical assistant solution such as a detergent, stain remover, oxygen-based bleaching agent, water or steam is applied to the substrate via the opening of the nozzle 132, the vacuum or suction pump 142 extracts contaminated chemical assistant solution via an orifice or opening, such as the orifice or opening of the extraction nozzle 143, providing a continual flow of chemical assistant solution across the substrate. The suction pump can be operated continually or repeatedly to provide continual or repeated replenishment of the solution during the cleaning process. It will be appreciated that the mechanism described in this embodiment to achieve flow of a chemical assistant solution can be achieved in a number of different formats and that the vacuum suction and delivery 132 and extraction 143 nozzles can be located internal to the apparatus or external to the apparatus. Further, the mechanism to achieve flow of chemical assistant solution can be incorporated with any other embodiment described within the current disclosure. Although in FIG. 13 a suction pump 142 and nozzle 143, as well as nozzle 132 are both shown, the apparatus need not include the opening of the nozzle 132, as in some practices of the invention a cleaning agent or other liquid or solution can be delivered externally, such as by a hand held dispenser. In some embodiments, the reservoir 111 can include compressed air or a pressurized aerosol.

FIG. 14 shows yet another embodiment of the present invention, which can incorporate one or more of the features of any of FIGS. 7-13, but again with the optical source 151 mounted external to the LIRON apparatus 150 (it could be inside) and where in this example, the vacuum or suction pump and/or the source of assistant mechanism (steam, gas, detergent, stain remover, oxygen-based bleaching agent etc) 152 are also mounted external to the apparatus and directed to the region of the optical beam, shown in FIG. 14, by an opening or orifice, such as an opening or orifice of the nozzle 153. In some embodiments, the reservoir 111 can include compressed air or a pressurized aerosol.

Also shown in FIG. 14 is an optional processor 154 which can be configured to output signals that control the cleaning of the substrate by the cleaning appliance. The processor can control one or more parameters of the overall cleaning process including, but not limited to, optical energy source 151 parameters, shaping optics 123 parameters, feature(s) 41 sensors 119, or nozzles 143/153. The processor's controlling capabilities can be updated and configured via an optional external user data interface 155 (i.e., USB, RS232), wireless communications (i.e., WiFi, Bluetooth), near-field communications (i.e., RFID reader, barcode reader) or a user input interface such as a keypad or touchpad 118.

A person of ordinary skill in the field of this invention, cognizant of the disclosure herein, will appreciate that a microprocessor can be integrated into any of the embodiments disclosed herein, such as (but not limited to) the embodiments shown in FIG. 7-15, to similarly control overall cleaning process parameters, including one or more of optical parameters or characteristics defined in more detail elsewhere herein.

As one example, referring to FIG. 9, a processor can receive signals from sensors 100 and, in response, alter optical characteristics of other cleaning process parameters, singularly or in combination, via communication with one or more of beam steering optics 88, beam shaping optics 89, scanning mirror 86, or optical energy source 103 parameters. Referring to FIG. 13, a microprocessor can receive signals from sensors 119 and, in response, manipulate overall cleaning process parameters, singularly or in combination, such as nozzle 132 dispense flow, suction pump 142 suction power, and optical parameters as previously discussed.

In embodiments comprising a processor, the processor can also be coupled with a data input source which allows the user to alter cleaning process parameters manually or automatically. A memory means can also be coupled with the processor to store pre-programmed cleaning recipes (i.e., sets of cleaning process parameters). Examples of manual alteration include inputting parameters through a knob, keypad or touchpad. Automatic alteration examples include importing data through a data port (i.e., USB, RS232), wireless communications (i.e., WiFi, Bluetooth), or near-field communications (i.e., RFID reader, barcode reader). Using one of these input means, the user can cause the microprocessor to load pre-programmed cleaning process parameters based on, for example, fabric and/or contaminant type. The user can also manually override select parameters directly through a knob, keypad or touch pad.

Figure 15:
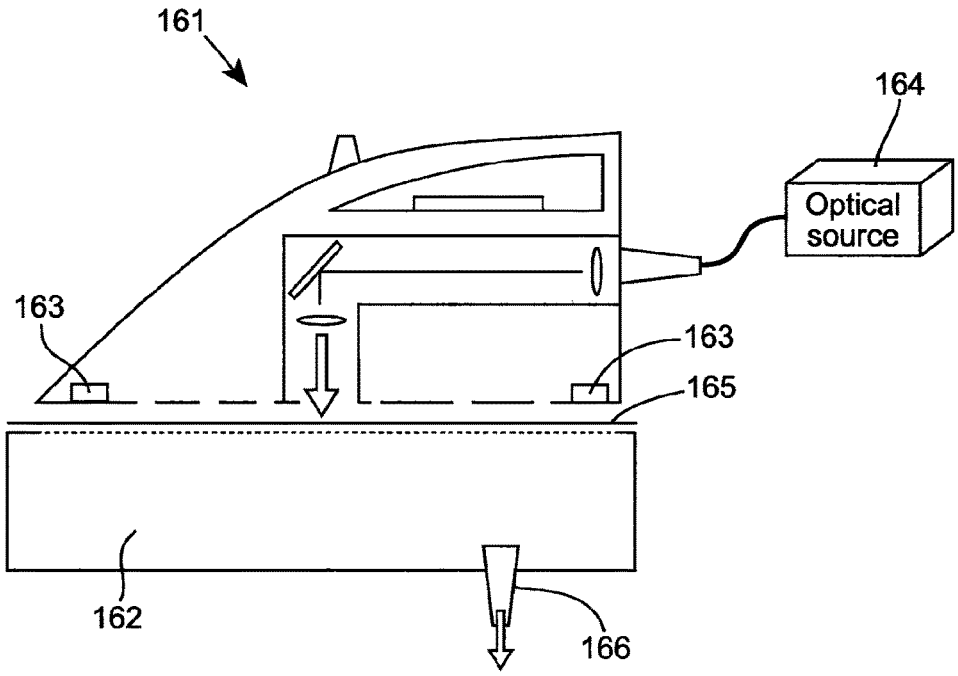
FIG. 15 schematically illustrates another embodiment of a LIRON apparatus 161 according to the present invention, where the LIRON is provided with a dedicated LIRON Board 162 similar to an ironing board onto which the substrate 165 (e.g., fabric material) can be positioned during the ironing process. The board can include a suction or vacuum pump 166 and perforated substrate mounting surface such that suction can be provided to the substrate to assist in removal of contaminants from the surface as well as aid in maintaining the substrate in place on the board.

FIG. 15 shows yet another embodiment of the present invention. The apparatus handheld cleaning device 161 can be in the form of any of the embodiments of this invention. In addition to the handheld apparatus, there is provided a specific base 162 which partners with the handheld or gantry mounted apparatus for cleaning. The base can be simple like a conventional ironing board used in domestic ironing processes. The base can contain other features which make up the entire cleaning and/or ironing system. For example, the base can be designed to enable the position sensors 163 and interlock system by containing part of the sensing system such that the apparatus optical source 164 can only operate when the apparatus is in position on the specific base. The position sensor could, for example, comprise an optical or electrical transmitter-detector pair, with one of the transmitter and detector being positioned within the base whilst the other remains with the hand-held cleaning apparatus. The base 162 could include sensors for sensing the proximity of the cleaning appliance, for purposes of providing an interlock. The sensors of the base can be in communication with the processor, which controls the operation of the optical source of conditioning element(s) 41 (e.g., a beam stop) in the appropriate optical path.

The base 162 of FIG. 15 can further comprise a suction pump 166 which serves to remove debris from the textile having been cleaned by the hand held cleaning apparatus. The suction pump also can provide a means for ensuring that the textile substrate 165 is flat against the top surface of the base. The suction pump 166 can be external to the base 162 or built into the base 162.

Figure 16:
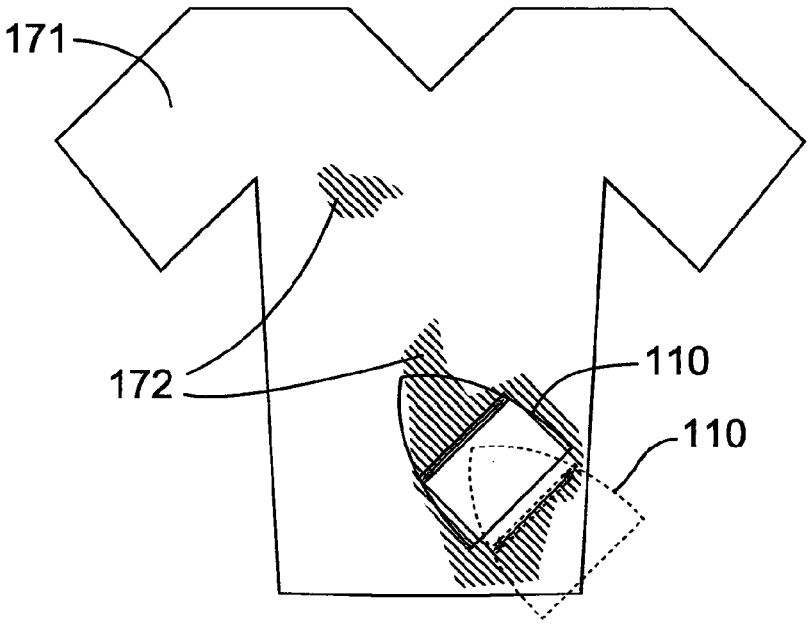
FIG. 16 illustrates an example of a method of cleaning a substrate comprising a fabric material (depicted in FIG. 18 as an item of clothing) according to an embodiment of the invention, which can be practiced, for example, using the apparatus shown in FIGS. 11-15.
Figure 17:
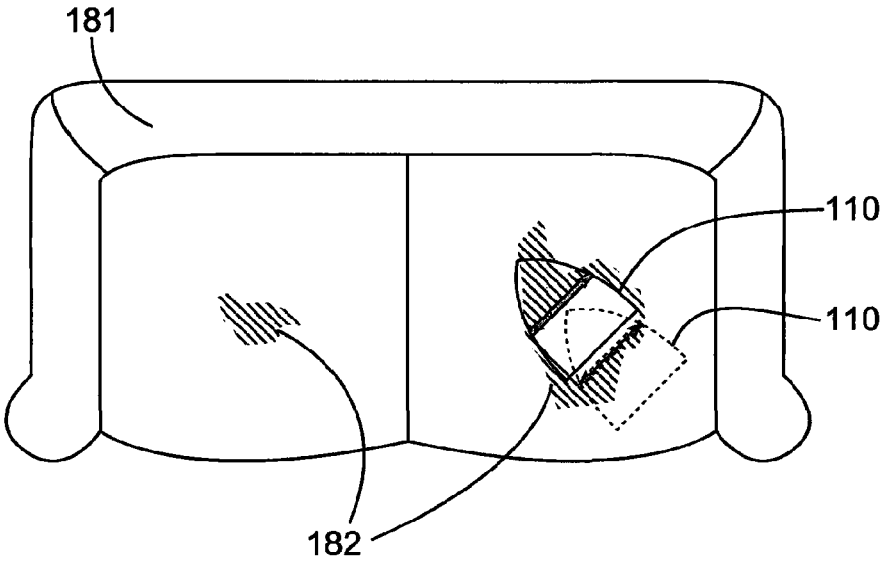
FIG. 17 illustrates another embodiment of a method of cleaning a substrate comprising a fabric material, (depicted in FIG. 19 as an item of furniture) according to an embodiment of the invention, which can be practiced, for example, using the apparatus shown in FIGS. 11-16.

FIGS. 16 and 17 show example uses of a hand-held cleaning and hand-held cleaning/ironing (LIRON) apparatus in the cleaning of fabric materials. The LIRON 110 of FIG. 10 is shown here but it will be appreciated that any of the apparatus of FIGS. 7-15 may be used in this way. FIG. 16 uses the case example of a clothing garment 171, whilst FIG. 17 uses an example of a textile covered (e.g., upholstered) piece of furniture 181. In both cases, the substrate has areas 172, 182 contaminated with dirt, stains, odours, etc. As the optical cleaning apparatus is scanned over the sample, the apparatus removes contaminant particles from the textile fibers providing a cleaning process. Equally, for the LIRON, the apparatus also provides the additional functionality of crease removal.

An optional data bearing element (173 in FIG. 16), such as a radio frequency identification (RFID) tag or bar code, which can be integral with the article to be cleaned, can include data for communication to the cleaning device, such as the LIRON, such data comprising cleaning process parameters and/or identification of the substrate material composition (i.e., cotton, silk, wool, etc.). For example, an RFID tag or barcode attached to a garment, containing information about the fabric type, can be read by an appropriate sensor in communication with the LIRON, responsive to which the a cleaning recipe, appropriate for the particular fabric type, can be followed responsive to the communicated data. The sensor can be mounted with the LIRON, which can include a processor, for processing or responding to the data and controlling the cleaning.

Figure 18:
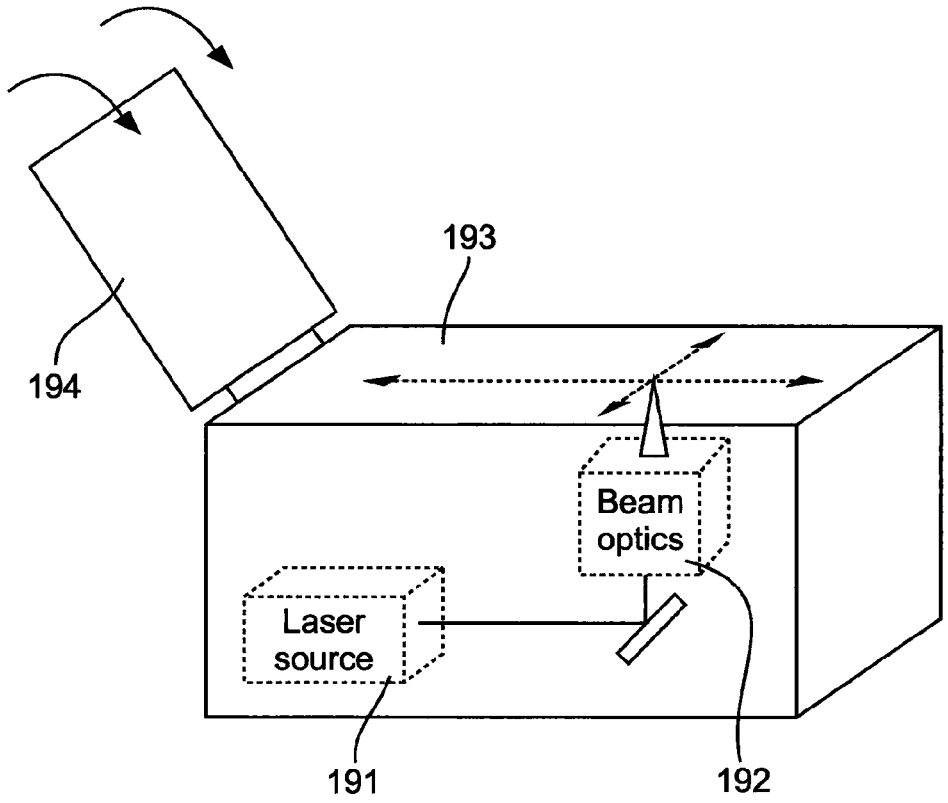
FIG. 18 illustrates another embodiment of an apparatus for practicing the present invention. The apparatus can include a "flatbed" design and an integral source of optical energy and a scanner unit which translates a beam through a transparent window to the surface of the substrate mounted on top of the transparent window. The apparatus can include a hinged lid that provides a light-tight seal whilst also helping to maintain the substrate in flat contact with the transparent window.

FIG. 18 shows another example embodiment of an optical cleaning apparatus based on a design similar to a flat-bed scanner or photocopier. In this example embodiment, the optical source 191, and beam steering and beam shaping optics 192 of the optical transmission pathway can be within an enclosure. The beam is directed upwards to the upper surface of the apparatus which is configured as an optically transmissive window 193. In this example, the beam is focussed to a spot at a point just above the window surface onto which the textile substrate can be placed flat, such that the beam is focussed on the textile substrate. Similarly, the beam could be in the form of a large spot for flood illumination or a stripe. The beam is scanned across the surface of the transmissive window such that the surface of the textile substrate is fully exposed to the beam during the scan process.

The apparatus includes a lid 194 which, when closed onto the fabric material, sandwiches the material flat against the transmissive window. The lid can also act to form a light-tight seal and provide the appropriate interlock safety features for, for example, systems where the potential optical exposure exceeds acceptable safety limits. Further, the lid can also provide suction, steam, water, gas, detergent, oxygen-based bleaching agent, stain removal and any other form of cleaning assistance.

Figure 19:
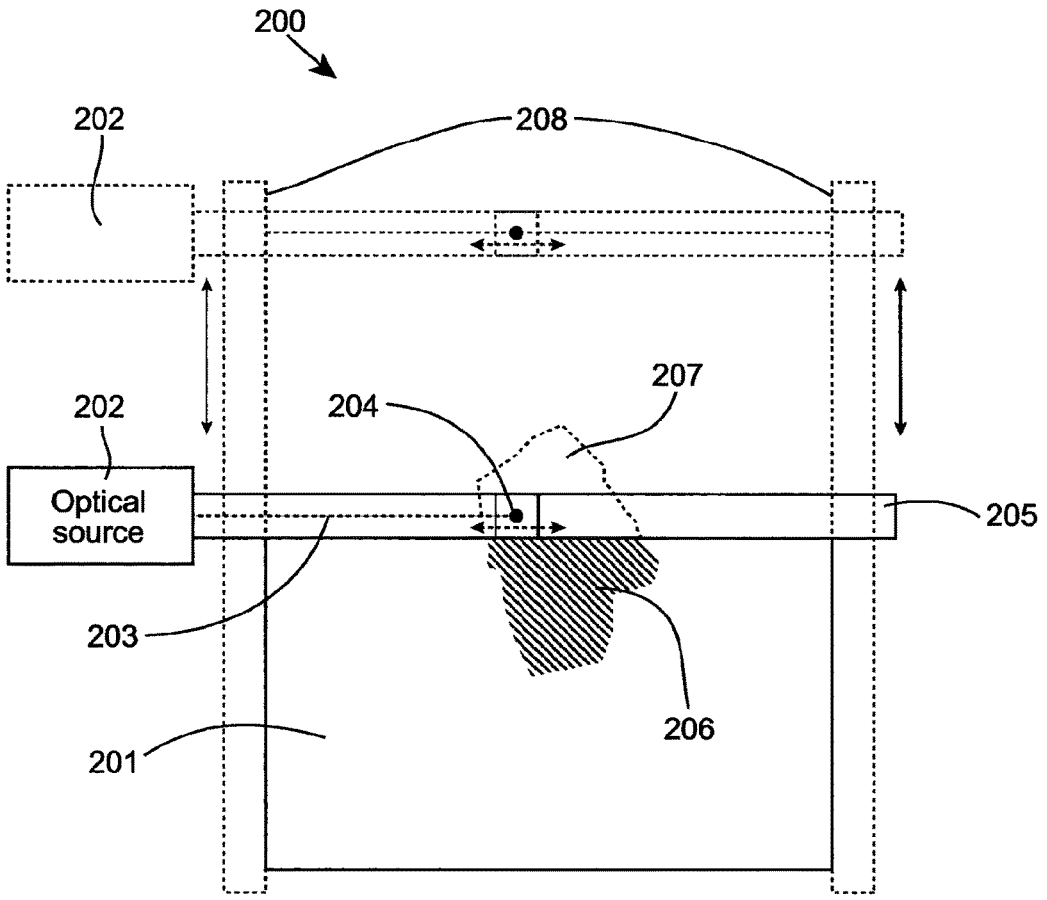
FIG. 19 illustrates another embodiment of an apparatus for practicing the present invention, wherein the substrate to be cleaned can be mounted vertically or horizontally, and the beam from the source of optical radiation can be scanned across the surface of the substrate through translation of the laser beam and/or optical source. The apparatus of FIG. 17 can be useful for industrial cleaning systems whereby large-area, flat substrates, such as sheets of material, are to be cleaned.

FIG. 19 shows another example apparatus according to another embodiment of the present invention. This apparatus 200 is suited to large area cleaning within, for example, industrial-scale cleaning process. In this apparatus, the substrate to be cleaned 201 is positioned flat and held in position. The apparatus includes an optical source 202 which provides an optical beam 203 which is beam shaped and directed onto the substrate by a beam steering optic 204. In this example embodiment, the beam steering optic is on a translation stage 205 which traverses horizontally across the substrate. The entire module of the optical source, translation stage and beam steering/shaping optics is also movable, along rollers 208, and traverses vertically (as shown in this specific example) such that the optical beam can cover the entire surface of the textile substrate to remove contaminants from contaminated regions of the substrate 206 to make the area clean 207.

It will be appreciated that the apparatus of FIGS. 18 and 19 can also include safety features and microprocessor control systems (not shown) described elsewhere herein. It will also be appreciated that the apparatus of FIGS. 18 and 19 can also include additional mechanisms for improving the cleaning process such as the use of steam, gas, detergents, vacuum or suction, stain removers and other types of cleaning assistance mechanisms, as described in conjunction with other embodiments herein.

WORKING EXAMPLES

FIG. 20 shows an example of a cotton fabric 300 having been contaminated with a dark oil from an engineering workshop. The piece of fabric is contaminated with a dark machine shop oil 302 and has been exposed to a pulsed laser source in a square region of approximately 15×15 mm dimension 304. The laser parameters include wavelength 1064 nm, pulse duration 20 nanoseconds and pulse energy of 800 uJ at a pulse repetition rate of 25 KHz. The output from the laser is focussed to spot diameter of approximately 30 um and scanned across the sample in a square pattern. The sample was soaked in water prior to cleaning which enhanced the process of contaminant removal.

FIG. 21*a* shows another example of a cleaned fabric sample 310 comprising a blue and white cotton shirt. The shirt, prior to cleaning with an apparatus and process according to the present invention, 312 had been contaminated with an orange coloured food stain 314. FIG. 21*a* shows the stained shirt after several attempts to wash it in a conventional laundry process using detergents and a mechanical, aqueous washing machine. The same shirt, shown in FIG. 21*b*, has been exposed to the laser cleaning process using an arrangement similar to FIG. 1, wherein the laser emitted short pulses of light in the visible range of the spectrum. The laser parameters included wavelength of 532 nm, pulse duration of approximately 200 nanoseconds and pulse energy of 200 up at a pulse repetition rate of 25 KHz. FIG. 21*d* shows the same section of the same shirt having no presence of the orange stain 322. This cleaning process was achieved using a focussed spot diameter of the laser of approximately 30 um in diameter and was achieved with approximately 4 passes of the laser beam over the contaminated region of the fabric. During the cleaning process, the fabric was wetted with water periodically to ensure the fabric remained wet at all times during the cleaning process.

In another example, the laser source comprises a fiber laser having wavelength of approximately 1064 nm and delivering up to 20 watts of average power in continuous wave (non-pulsed) to the substrate. In this example, the substrate is partially immersed in a solution comprising water and detergent, said detergent containing an oxygen-based bleaching agent (sodium percarbonate though other similar agents can be used). The beam is focussed to a spot of approximately 30 micrometers in diameter, enabling a high fluence to be attained within a reasonable depth of focus through the fabric material. The fabric is contaminated with a stain such as red-wine, such as curry, such as grass stain or any other type of conventional stain. The stain can be new or can be an old stain having survived many previous cleaning attempts. On scanning the beam across the stained area of the fabric substrate, the stain molecules are removed and/or bleached by the combination of the optical energy and the detergent solution, the optical energy providing a combination of localised heating to assist the oxygen-based bleaching agent and/or enzyme and/or surfactant performance at removing or bleaching the stain as well as providing energy to the contaminant molecules making them more mobile and hence easier to remove and/or bleach. The beam is scanned over the contaminated substrate area on one or more passes to remove or bleach the contaminant or stain. For small levels of contamination, there is no need to replenish the detergent solution. For larger amounts of contamination, the solution is repeatedly or continually replaced, preventing the build-up of highly contaminated solution and subsequent re-absorption of the contaminant by the substrate. In this case of high levels of contamination, the detergent solution is preferably flowed repeatedly or continually over the substrate as the optical beam is scanned during the cleaning process.

Figure 22:
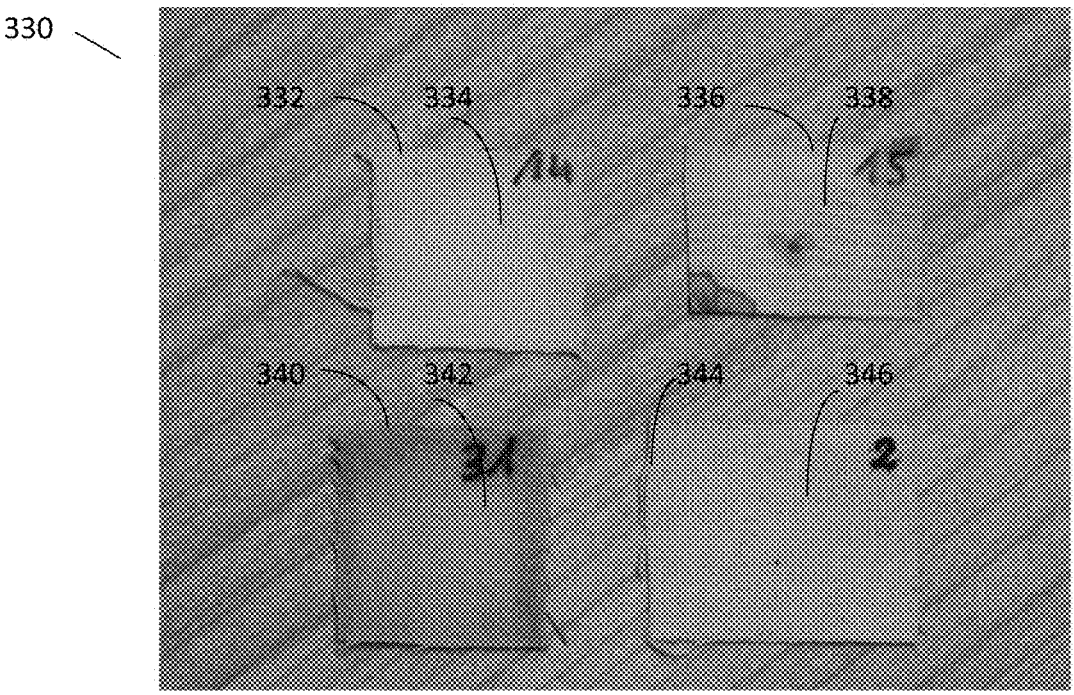
FIG. 22 shows examples of the laser cleaning of samples of cotton material, contaminated with different food stains such as tea, curry and oil, red wine, and grass.

More particularly, FIG. 22 shows samples of cotton material, contaminated with different food stains including tea 322, curry and oil 336, red wine 340, and grass 344. The samples have all been exposed to the laser cleaning process using an arrangement similar to FIG. 1, wherein the laser emitted continuous wave light in the near Infra Red region of the spectrum. The laser is a continuous wave fiber laser operating at a wavelength of 1064 nm, and an average power of approximately 20 Watts. The beam of the laser was focussed close to the surface of the fabric samples with a spot diameter of approximately 30 um and scanned line by line to cover a square 15 mm×15 mm region of the fabric in a multi-pass process. During the process, the samples have been immersed in a solution of detergent made using a commercial laundry powder comprising approximately 15% oxygen-based bleaching agent sodium percarbonate.

FIG. 22 also shows the laser-exposed sections of the fabric samples respectively 334, 338, 342 and 346. In each case these samples were processed by 4-passes of the laser scanning at 400 mm per second with a hatching of approximately 40 μm. It was observed during the processing that contaminant was removed on each pass of the laser scan over the fabric sample. During each pass, the detergent solution was observed to change in colour due to removed contaminant from the fabric. Following 4-passes of the laser scan on the samples, the detergent solution was heavily discoloured and would result in re-absorption of the contaminant within the fabric sample, degrading the overall quality of the cleaning process. This result identifies a preferred solution of continuously replenishing the detergent, be it in solution, solid or in vapour format. A further observation from this process was that the cleaning quality was significantly reduced when the fabric sample was immersed in the solution by more than approximately 1 mm to 2 mm.

It is appreciated that the process examples described herein with reference to FIGS. 20-22 are examples and that the type of fabric, contaminant, laser wavelength, pulse duration, spot size or shape, scan speed and scan parameters, such as the linear approach to scanning, detergent and detergent application method can all be changed whilst still falling within the scope of this current invention.

In the examples above, it is considered, as with the other embodiments herein, that the laser source can comprise a high power, multi-mode laser diode having a wavelength below 1000 nm and delivering in excess of 100 Watts in a larger, 100 um diameter focussed spot.

It is also considered that the optical source can comprise a very high power lamp such as a Xenon arc lamp which delivers greater than 100 watts of broadband optical power to a spot in excess of 100 um in diameter focussed onto the substrate.

The forgoing parameters of pulse time duration, average power, pulse energy and wavelength can be used in conjunction with any of other embodiments of the invention disclosed herein.

It will be appreciated that the specific orientations used within these FIGURES to demonstrate the apparatus functionality are by way of example only.

The present disclosure is directed to each individual feature, system, material, and/or method described herein. In addition, any combination of two or more such features, systems, materials, and/or methods, if such features, systems, materials, and/or methods are not mutually inconsistent, is included within the scope of the present invention. To avoid undue repetition, not all features are discussed in conjunction with every aspect, embodiment or practice of the disclosure. Features described in conjunction with one aspect, embodiment or practice are deemed to be includable with others absent mutual inconsistency or a clear teaching to the contrary. In some instances, features will be discussed generally rather than in detail in conjunction with a specific aspect, embodiment or practice, and it is understood that such features can be included in any aspect, embodiment or practice, again absent mutual inconsistency or a clear teaching to the contrary.

Those of ordinary skill in the art will readily envision a variety of other means and structures for performing the functions and/or obtaining the results or advantages described herein and each of such variations or modifications is deemed to be within the scope of the present invention. More generally, those skilled in the art would readily appreciate that all parameters, dimensions, materials and configurations described herein are meant to be exemplary and that actual parameters, dimensions, materials and configurations will depend on specific applications for which the teachings of the present invention are used.

Those skilled in the art will recognize or be able to ascertain using no more than routine experimentation many equivalents to the specific embodiments of the invention described herein. It is therefore to be understood that the foregoing embodiments are presented by way of example only and that within the scope of the appended claims, and equivalents thereto, the invention may be practiced otherwise than as specifically described.

In the claims as well as in the specification above all transitional phrases such as "comprising", "including", "carrying", "having", "containing", "involving" and the like are understood to be open-ended. Only the transitional phrases "consisting of" and "consisting essentially of" shall be closed or semi-closed transitional phrases, respectively, as set forth in the U.S. Patent Office Manual of Patent Examining Procedure § 2111.03, $8^{th}$ Edition, Revision 8. Furthermore, statements in the specification, such as, for example, definitions, are understood to be open ended unless otherwise explicitly limited.

The phrase "A or B" as in "one of A or B" is generally meant to express the inclusive "or" function, meaning that all three of the possibilities of A, B or both A and B are included, unless the context clearly indicates that the exclusive "or" is appropriate (i.e., A and B are mutually exclusive and cannot be present at the same time). "At least one of A, B or C" (as well as "at least one of A, B and C") reads on any combination of one or more of A, B and C, including, for example the following: A; B; C; A & B; A & C; B & C; A & B; as well as on A, B & C.

It is generally well accepted in patent law that "a" means "at least one" or "one or more." Nevertheless, there are occasionally holdings to the contrary. For clarity, as used herein "a" and the like mean "at least one" or "one or more." The phrase "at least one" may at times be explicitly used to emphasize this point. Use of the phrase "at least one" in one claim recitation is not to be taken to mean that the absence of such a term in another recitation (e.g., simply using "a") is somehow more limiting. Furthermore, later reference to the term "at least one" as in "said at least one" should not be taken to introduce additional limitations absent express recitation of such limitations. For example, recitation that an apparatus includes "at least one widget" and subsequent recitation that "said at least one widget is colored red" does not mean that the claim requires all widgets of an apparatus that has more than one widget to be red. The claim shall read on an apparatus having one or more widgets provided simply that at least one of the widgets is colored red. Similarly, the recitation that "each of a plurality" of widgets is colored red shall also not mean that all widgets of an apparatus that has more than two red widgets must be red; plurality means two or more and the limitation reads on two or more widgets being red, regardless of whether a third is included that is not red, absent more limiting explicit language (e.g., a recitation to the effect that each and every widget of a plurality of widgets is red).

What is claimed is:

1. A method of cleaning a substrate comprising a fabric material with optical energy, comprising:

applying cleaning agent to the fabric material;

applying optical energy from a source of optical energy to the fabric material having the cleaning agent applied thereto, the optical energy being emanated to the fabric via an aperture of a work surface of a handheld cleaning appliance and effectuating removal of contaminants from the fabric material;

wherein the aperture emanates the optical energy to the fabric material during sliding contact between the work surface and the fabric material; and wherein the source of optical energy comprises a laser.

2. The method of claim 1 further comprising the step of:

selectively applying a cleaning agent to said fabric material, said cleaning agent including a bleaching agent.

3. The method of claim 1 further comprising the step of:

selectively applying a cleaning agent to said fabric material, said cleaning agent including an oxidizing agent, the cleaning agent comprising at least 5% by weight of the oxidizing agent.

4. The method of claim 1 wherein applying the optical energy comprises applying the optical energy so as to heat one or both of the cleaning agent or at least a portion of the fabric material to a temperature of at least 40 degrees Celsius.

5. The method of claim 1 comprising removing, after the step of applying optical energy to the fabric material having the cleaning agent applied thereto, cleaning agent from the fabric material.

6. The method of claim 5 comprising applying, subsequent to the removal of cleaning agent, additional cleaning agent to the fabric material.

7. The method of claim 1 wherein the optical energy having one or more optical parameters selected for cleaning the substrate comprises the optical energy having a duty cycle of no less than 10%.

8. The method of claim 1, wherein the cleaning agent comprises an absorbing agent for enhancing absorption of the optical energy by the cleaning agent.

9. The method of claim 1, wherein the handheld cleaning appliance further comprises a suction pump.

10. The method of claim 1, wherein the handheld cleaning appliance comprises a proximity sensor arrangement for providing control of the emanation of optical energy for cleaning from the aperture responsive to the proximity of the fabric material to the aperture.

11. The method of claim 1, wherein the handheld cleaning appliance is arranged and constructed such that the cleaning with the optical energy is blind as to a user holding the cleaning appliance in their hand for cleaning.

12. The method of claim 1, wherein the laser comprises a laser diode.

13. A method of cleaning a substrate with optical energy, comprising:

applying cleaning agent comprising a bleaching agent or an oxidizing agent to the substrate with a handheld cleaning appliance that includes an aperture for emanating optical energy provided by a source of optical energy;

applying the optical energy from the aperture to the substrate having the cleaning agent applied thereto, the optical energy having one or more optical parameters selected for cleaning the substrate;

wherein said cleaning appliance is of a size and weight such that it can be readily spatially oriented in any direction with a single hand; and wherein the source of optical energy comprises a laser.

14. The method of claim 13 wherein the cleaning agent comprises the bleaching agent.

15. The method of claim 13 wherein the cleaning agent comprises the oxidizing agent, the cleaning agent comprising at least 5% by weight of the oxidizing agent.

16. The method of claim 13 wherein applying the optical energy comprises applying the optical energy so as to heat one or both of the cleaning agent or at least a portion of the substrate to a temperature of at least 40 degrees Celsius.

17. The method of claim 13 comprising removing, after the step of applying optical energy to the substrate having the cleaning agent applied thereto, cleaning agent from the substrate.

18. The method of claim 17 comprising applying, subsequent to the removal of cleaning agent, additional cleaning agent to the substrate.

19. The method of claim 13 wherein the optical energy having one or more optical parameters selected for cleaning the substrate comprises the optical energy having a duty cycle of no less than 10%.

20. The method of claim 13, wherein the cleaning agent comprises an absorbing agent for enhancing absorption of the optical energy by the cleaning agent.

21. The method of claim 13, wherein the handheld cleaning appliance further comprises a suction pump.

22. The method of claim 13, wherein the handheld cleaning appliance is further arranged and constructed such that the cleaning with the optical energy is blind as to a user holding the cleaning appliance in their hand for cleaning.

23. The method of claim 13, wherein the laser comprises a laser diode.

24. A method of cleaning a substrate with optical energy, comprising:

applying cleaning agent comprising a bleaching agent or an oxidizing agent to the substrate;

applying optical energy to the substrate having the cleaning agent applied thereto, the optical energy having one or more optical parameters selected for cleaning the substrate;

the optical energy being provided by a source of optical energy and being emanated from an aperture of a handheld cleaning appliance;

wherein said cleaning appliance is of a size and weight such that it can be readily spatially oriented in any direction with a single hand;

wherein the source of optical energy comprises a laser; and wherein the handheld cleaning appliance further comprises a proximity sensor arrangement for providing control of the emanation of optical energy for cleaning from the aperture responsive to the proximity of the substrate to the aperture.

* * * * *